US008755546B2

(12) United States Patent
Terada et al.

(10) Patent No.: US 8,755,546 B2
(45) Date of Patent: Jun. 17, 2014

(54) SOUND PROCESSING APPARATUS, SOUND PROCESSING METHOD AND HEARING AID

(75) Inventors: Yasuhiro Terada, Kanagawa (JP); Maki Yamada, Kanagawa (JP)

(73) Assignee: Pansonic Corporation, Osaka (JP)

( * ) Notice: Subject to any disclaimer, the term of this patent is extended or adjusted under 35 U.S.C. 154(b) by 135 days.

(21) Appl. No.: 13/499,027

(22) PCT Filed: Oct. 20, 2010

(86) PCT No.: PCT/JP2010/006231
§ 371 (c)(1),
(2), (4) Date: Mar. 29, 2012

(87) PCT Pub. No.: WO2011/048813
PCT Pub. Date: Apr. 28, 2011

(65) Prior Publication Data

US 2012/0189147 A1 Jul. 26, 2012

(30) Foreign Application Priority Data

Oct. 21, 2009 (JP) ..... 2009-242602

(51) Int. Cl.
*H04R 25/00* (2006.01)

(52) U.S. Cl.
USPC ..... 381/317; 381/313; 381/321; 381/94.7; 381/92; 367/119; 367/124

(58) Field of Classification Search
USPC ..... 381/313, 92, 71.1, 17, 57, 66, 56, 107, 381/122, 18, 2, 58, 94.7, 355, 356, 317, 381/321, 94.1; 704/E21.002, E15.001, 226, 704/233, E11.003, E15.039, E19.005, 2, 704/214, 225, 228, 236, 237; 455/11.1, 455/226.1, 24, 41.1, 67.12, 67.16, 202.01, 455/420.02; 367/119, 124
See application file for complete search history.

(56) References Cited

U.S. PATENT DOCUMENTS 6,243,322 B1 * 6/2001 Zakarauskas ..... 367/127
2002/0191803 A1 12/2002 Asada et al.

(Continued)

FOREIGN PATENT DOCUMENTS

CN 101031162 9/2007
JP 5-207587 8/1993

(Continued)

OTHER PUBLICATIONS

International Search Report issued Nov. 16, 2010 in International (PCT) Application No. PCT/JP2010/006231.

*Primary Examiner* — Curtis Kuntz
*Assistant Examiner* — Joshua A Kaufman
(74) *Attorney, Agent, or Firm* — Wenderoth, Lind & Ponack, L.L.P.

(57) ABSTRACT

A sound processing apparatus, a sound processing method and a hearing aid efficiently emphasize the sound of an utterer regardless of the distance between microphones. The sound processing apparatus outputs a first directivity signal in which the main axis of directivity is formed in the direction of the utterer and outputs a second directivity signal in which the dead zone of directivity is formed in the direction of the utterer. The sound processing apparatus calculates the level of the first directivity signal and the level of the second directivity signal, and determines the distance to the utterer based on the level of the first directivity signal and the level of the second directivity signal. The sound processing apparatus derives a gain to be given to the first directivity signal according to the result of the determination and controls the level of the first directivity signal by using the gain.

6 Claims, 30 Drawing Sheets

(56) References Cited

U.S. PATENT DOCUMENTS

| | | | | |
|---|---|---|---|---|
| 2004/0141418 | A1* | 7/2004 | Matsuo et al. | 367/124 |
| 2004/0170284 | A1* | 9/2004 | Janse et al. | 381/66 |
| 2007/0253574 | A1* | 11/2007 | Soulodre | 381/94.2 |
| 2009/0003626 | A1* | 1/2009 | Burnett | 381/92 |
| 2009/0076815 | A1* | 3/2009 | Ichikawa et al. | 704/233 |
| 2010/0111329 | A1 | 5/2010 | Namba et al. | |
| 2010/0128881 | A1* | 5/2010 | Petit et al. | 381/56 |

FOREIGN PATENT DOCUMENTS

| | | |
|---|---|---|
| JP | 9-311696 | 12/1997 |
| JP | 2004-226656 | 8/2004 |
| JP | 2008-312002 | 12/2008 |
| JP | 2009-36810 | 2/2009 |
| JP | 2010-112996 | 5/2010 |

* cited by examiner

WHEN SELF-UTTERANCE SOUND DETERMINATION RESULT INFORMATION IS OUTPUT TO UTTERER DISTANCE DETERMINATION SECTION

SOUND PROCESSING APPARATUS, SOUND PROCESSING METHOD AND HEARING AID

BACKGROUND OF THE INVENTION

1. Technical Field

The present invention relates to a sound processing apparatus, a sound processing method and a hearing aid, capable of allowing the user to easily hear the sound of an utterer close to the user by emphasizing the sound of the utterer close to the user relative to the sound of an utterer far away from the user.

2. Background Art

Patent Document 1 is an example of a sound processing apparatus for emphasizing only the sound of an utterer close to the user. According to Patent document 1, near-field sound is emphasized by using the amplitude ratio of the sound input to microphones disposed away from each other by appropriately 50 [cm] to 1 [m] and on the basis of a weighting function that has been calculated in advance so as to correspond to the amplitude ratio. FIG. 30 is a block diagram showing an internal configuration of the sound processing apparatus disclosed in Patent document 1.

In FIG. 30, to a divider 1614, the amplitude value of a microphone 1601A calculated by a first amplitude extractor 1613A and the amplitude value of a microphone 1601B calculated by a second amplitude extractor 1613B are input. Next, the divider 1614 obtains the amplitude ratio between the microphones A and B on the basis of the amplitude value of the microphone 1601A and the amplitude value of the microphone 1601B. A coefficient calculator 1615 calculates a weighting coefficient corresponding to the amplitude ratio calculated by the divider 1614. A near-field sound source separation apparatus 1602 is configured to emphasize near-field sound by using the weighting function that has been calculated in advance according to the amplitude ratio calculated by the coefficient calculator 1615.

RELATED ART DOCUMENTS

Patent Documents

Patent Document 1: JP-A-2009-36810

SUMMARY OF THE INVENTION

However, in the case that the sound of a sound source or an utterer close to the user is desired to be emphasized by using the above-mentioned near-field sound source separation apparatus 1602, a large amplitude ratio is required to be obtained between the microphones 1601A and 1601B. For this reason, the two microphones 1601A and 1601B are required to be disposed so that a considerably large distance is provided therebetween. Hence, it is difficult to apply the apparatus to a compact sound processing apparatus in which microphones are disposed so that the distance therebetween is particularly in a range of several [mm] (millimeters) to several [cm] (centimeters).

In particular, in a low frequency band, the amplitude ratio between the two microphones becomes small; hence, it is difficult to properly distinguish between a sound source or an utterer close to the user and a sound source or an utterer far away from the user.

In view of the above circumstances according to the conventional art, an object of the present invention is to provide a sound processing apparatus, a sound processing method and a hearing aid, for efficiently emphasizing the sound of an utterer close to the user regardless of the distance between microphones.

A sound processing apparatus of the present invention includes: a first directivity forming section configured to output a first directivity signal in which a main axis of directivity is formed in a direction of an utterer by using output signals from a plurality of omnidirectional microphones, respectively; a second directivity forming section configured to output a second directivity signal in which a dead zone of directivity is formed in the direction of the utterer by using the output signals from the respective omnidirectional microphones; a first level calculation section configured to calculate a level of the first directivity signal output from the first directivity forming section; a second level calculation section configured to calculate a level of the second directivity signal output from the second directivity forming section; an utterer distance determination section configured to determine a distance to the utterer based on the level of the first directivity signal and the level of the second directivity signal calculated by the first and second level calculation sections; a gain derivation section configured to derive a gain to be given to the first directivity signal according to a result of the utterer distance determination section, and a level control section configured to control the level of the first directivity signal by using the gain derived from the gain derivation section.

A sound processing method of the present invention includes: a step of outputting a first directivity signal in which a main axis of directivity is formed in a direction of an utterer by using output signals from a plurality of omnidirectional microphones, respectively; a step of outputting a second directivity signal in which a dead zone of directivity is formed in the direction of the utterer by using the output signals from the respective omnidirectional microphones; a step of calculating a level of the output first directivity signal; a step of calculating a level of the output second directivity signal; a step of determining a distance to the utterer based on the calculated level of the first directivity signal and the calculated level of the second directivity signal; a step of deriving a gain to be given to the first directivity signal according to the determined distance to the utterer, and a step of controlling the level of the first directivity signal by using the derived gain.

A hearing aid of the present invention includes the sound processing apparatus described above.

According to the sound processing apparatus, the sound processing method and the hearing aid of the present invention, the sound of the utterer close to the user can be efficiently emphasized irrespective of the distance between the microphones.

DETAILED DESCRIPTION OF THE INVENTION

Figure 1:
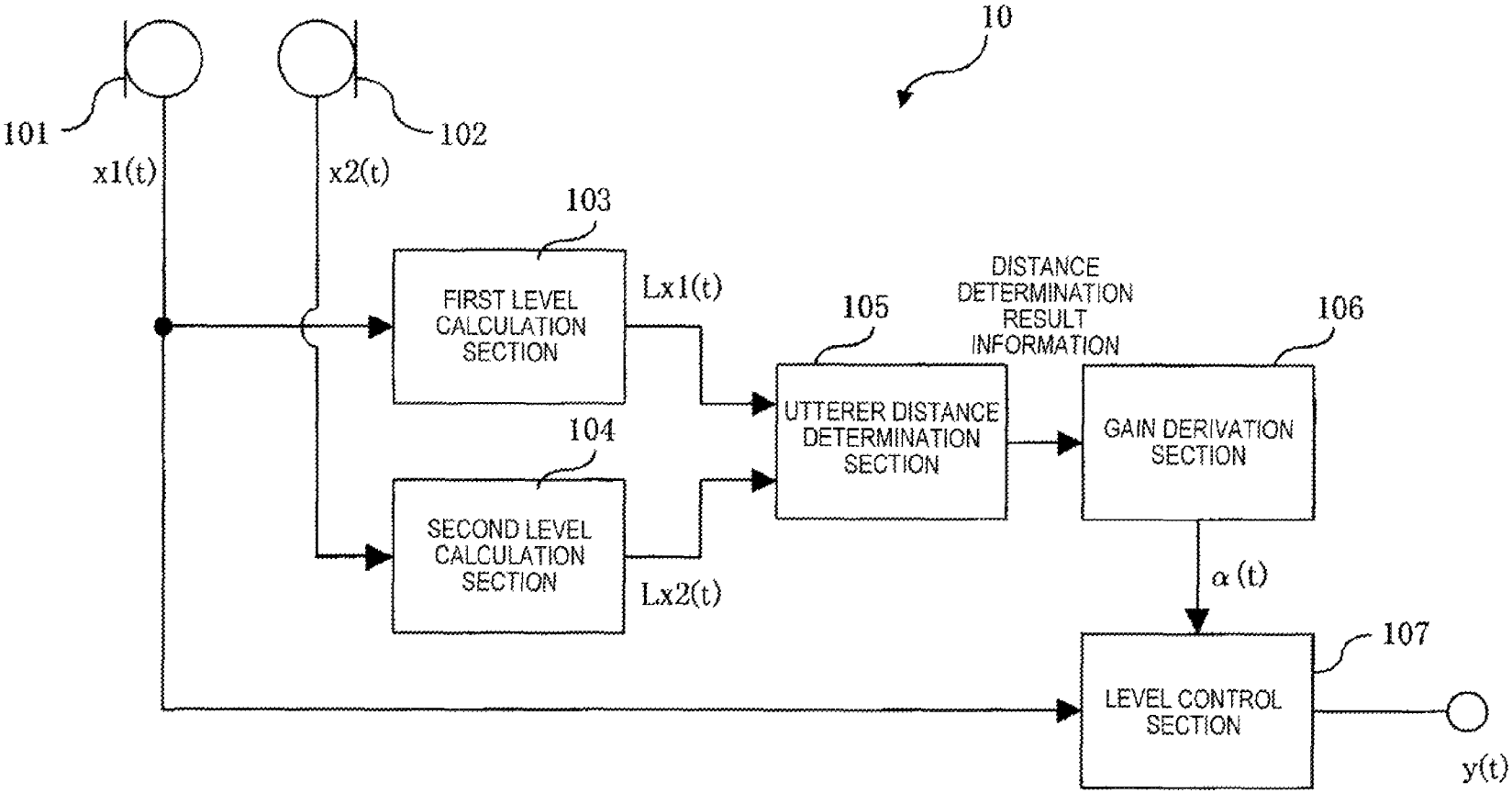
FIG. 1 is a block diagram showing an internal configuration of a sound processing apparatus according to a first embodiment.

Embodiments according to the present invention will be described below referring to the drawings. In each embodiment, an example in which a sound processing apparatus according to the present invention is applied to a hearing aid will be described. Hence, it is assumed that the sound processing apparatus is placed inside an ear of the user and that an utterer is located nearly on the front side and in front of the user.

First Embodiment

FIG. 1 is a block diagram showing an internal configuration of a sound processing apparatus 10 according to a first embodiment. As shown in FIG. 1, the sound processing apparatus 10 has a first directional microphone 101, a second directional microphone 102, a first level calculation section 103, a second level calculation section 104, an utterer distance determination section 105, a gain derivation section 106, and a level control section 107.

(The Internal Configuration of the Sound Processing Apparatus 10 According to the First Embodiment)

The first directional microphone 101 is a unidirectional microphone having the main axis of directivity in the direction of the utterer and mainly picks up the direct sound of the sound of the utterer. The first directional microphone 101 outputs this picked-up sound signal x1(*t*) to each of the first level calculation section 103 and the level control section 107.

The second directional microphone 102 is a unidirectional microphone or a bidirectional microphone having a directional dead zone in the direction of the utterer, does not pick up the direct sound of the sound of the utterer, but picks up the reverberant sound of the sound of the utterer mainly generated by the reflection from the wall or the like of a room. The second directional microphone 102 outputs this picked-up sound signal x2(*t*) to the second level calculation section 104. Furthermore, the distance between the first directional microphone 101 and the second directional microphone 102 is a distance of approximately several [mm] to several [cm].

The first level calculation section 103 obtains the sound signal x1(*t*) output from the first directional microphone 101 and calculates the level Lx1(*t*) [dB] of the obtained sound signal x1(*t*). The first level calculation section 103 outputs the level Lx1(*t*) of the calculated sound signal x1(*t*) to the utterer distance determination section 105. Mathematical expression (1) shows an example of the calculation expression of the level Lx1(*t*) that is calculated by the first level calculation section 103.

[Mathematical expression 1]

$$Lx1(t) = 10\log_{10}\left(\tau \cdot \frac{1}{N}\sum_{n=0}^{N-1} x1^2(t-n) + (1-\tau)\cdot 10^{Lx1(t-1)/10}\right) \quad (1)$$

In Mathematical expression (1), N is the number of samples required for the level calculation. For example, in the case that the sampling frequency is 8 [kHz] and that the analysis time for the level calculation is 20 [ms], the number N of samples becomes N=160. In addition, τ represents a time constant, has a value in the range of $0<\tau\leq 1$ and has been determined in advance. As the time constant τ, for the purpose of promptly following the rising of sound, as represented by Mathematical expression (2) described below,

[Mathematical expression 2]

$$10\log_{10}\left(\frac{1}{N}\sum_{n=0}^{N-1} x1^2(t-n)\right) > Lx1(t-1) \quad (2)$$

in the case that this relationship is established, a small time constant is used. On the other hand, in the case that the relationship represented by Mathematical expression (2) described above is not established (Mathematical expression (3)), a large time constant is used to reduce the lowering of the level in the consonant sections of sound or between the phrases of sound.

[Mathematical expression 3]

$$10\log_{10}\left(\frac{1}{N}\sum_{n=0}^{N-1} x1^2(t-n)\right) \leq Lx1(t-1) \quad (3)$$

Figure 2:
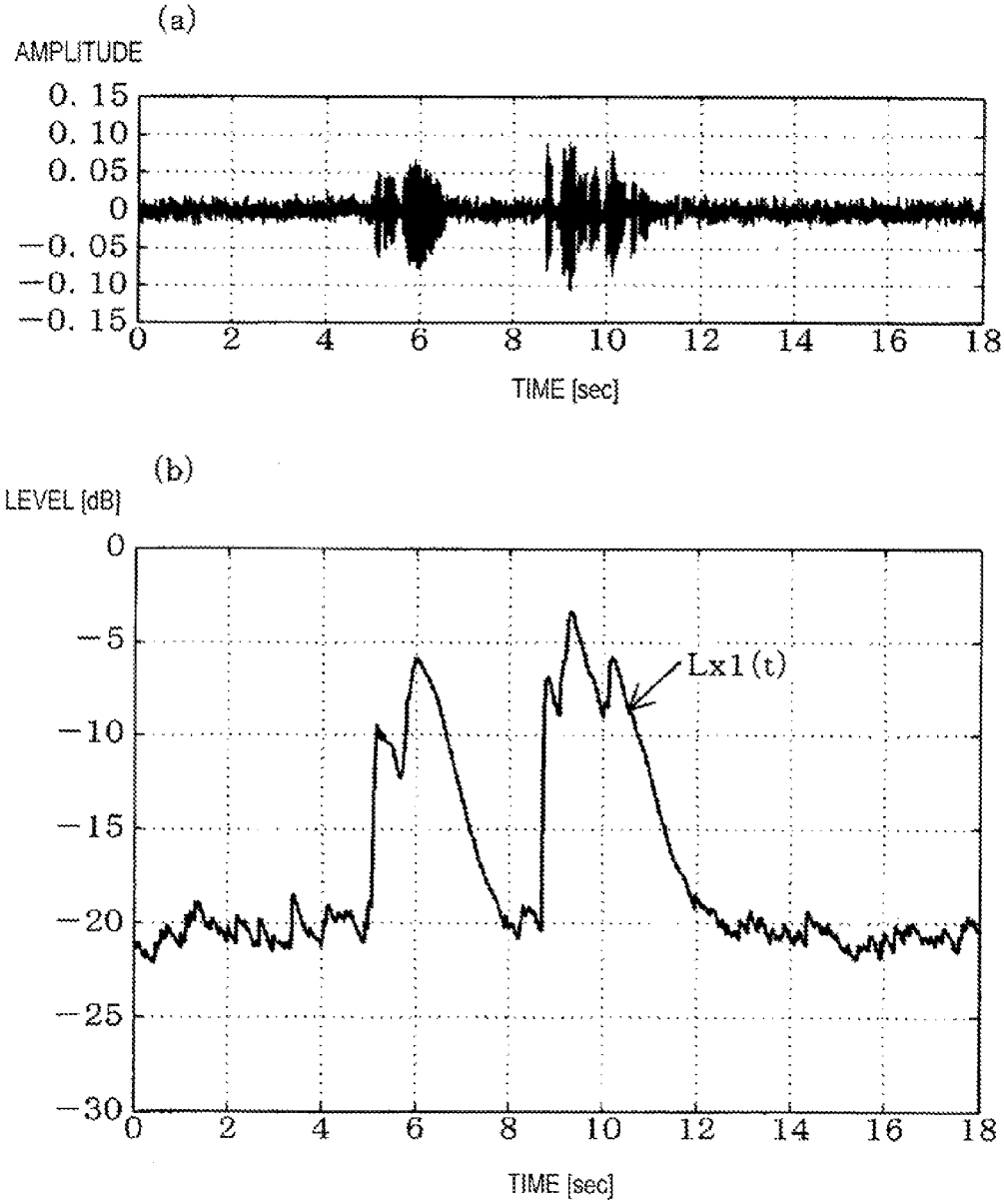
FIG. 2 is a view showing an example of the time change in the sound waveform output from a first directional microphone and a view showing an example of the time change in the level calculated by a first level calculation section; (a) is a view showing the time change in the sound waveform output from the first directional microphone, and (b) is a view showing the time change in the level calculated by the first level calculation section.

FIG. 2 shows the waveform of the sound output from the first directional microphone 101 and the level Lx1(*t*) obtained when the first level calculation section 103 performed calculation. The level Lx1(*t*) is an example calculated by the first level calculation section 103 in the case that the time constant in the case of Mathematical expression (2) is 100 [ms] and that the time constant in the case of Mathematical expression (3) is 400 [ms].

FIG. 2(*a*) is a view showing the time change in the waveform of the sound output from the first directional microphone 101, and FIG. 2(*b*) is a view showing the time change in the level calculated by the first level calculation section 103. In FIG. 2(*a*), the vertical axis represents amplitude, and the horizontal axis represents time [sec]. In FIG. 2(*b*), the vertical axis represents level, and the horizontal axis represents time [sec].

The second level calculation section 104 obtains the sound signal x2(*t*) output from the second directional microphone 102 and calculates the level Lx2(*t*) of the obtained sound signal x2(*t*). The second level calculation section 104 outputs the calculated level Lx2(*t*) of the sound signal x2(*t*) to the utterer distance determination section 105. The calculation expression of the level Lx2(*t*) calculated by the second level calculation section 104 is the same as Mathematical expression (1) by which the level Lx1(*t*) is calculated.

Figure 3:
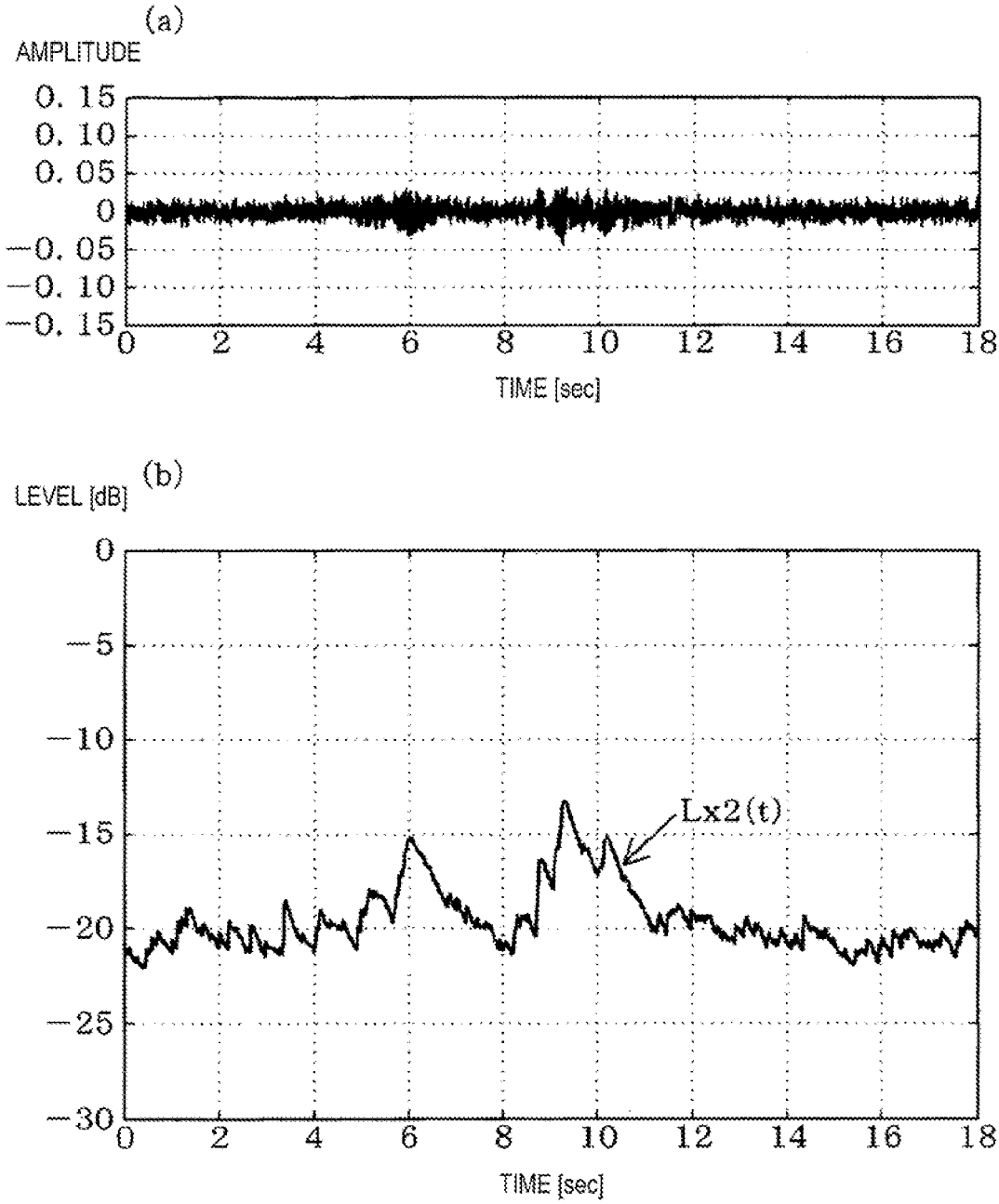
FIG. 3 is a view showing an example of the time change in the sound waveform output from a second directional microphone and a view showing an example of the time change in the level calculated by a second level calculation section; (a) is a view showing the time change in the sound waveform output from the second directional microphone, and (b) is a view showing the time change in the level calculated by the second level calculation section.

FIG. 3 shows the waveform of the sound output from the second directional microphone 102 and the level Lx2(*t*) obtained when calculation is performed by the second level calculation section 104. The level Lx2(*t*) is an example calculated by the second level calculation section 104 in the case that the time constant in the case of Mathematical expression (2) is 100 [ms] and that the time constant in the case of Mathematical expression (3) is 400 [ms].

FIG. 3(*a*) is a view showing the time change in the waveform of the sound output from the second directional microphone 102. Furthermore, FIG. 3(*b*) is a view showing the time change in the level calculated by the second level calculation section 104. In FIG. 3(*a*), the vertical axis represents amplitude, and the horizontal axis represents time [sec]. In FIG. 3(*b*), the vertical axis represents level, and the horizontal axis represents time [sec].

The utterer distance determination section 105 obtains the level Lx1(*t*) of the sound signal x1(*t*) calculated by the first level calculation section 103 and the level Lx2(*t*) of the sound signal x2(*t*) calculated by the second level calculation section 103. On the basis of these obtained level Lx1(*t*) and level Lx2(*t*), the utterer distance determination section 105 determines whether the utterer is close to the user. The utterer distance determination section 105 outputs distance determination result information serving as the result of the determination to the gain derivation section 106.

More specifically, to the utterer distance determination section 105, the level Lx1(*t*) of the sound signal x1(*t*) calculated by the first level calculation section 103 and the level Lx2(*t*) of the sound signal x2(*t*) calculated by the second level calculation section 104 are input. Next, the utterer distance determination section 105 calculates the level difference ΔLx(t)=Lx1(*t*)−Lx2(*t*) serving as the difference between the level Lx1(*t*) of the sound signal x1(*t*) and the level Lx2(*t*) of the sound signal x2(*t*).

On the basis of the calculated level difference ΔLx(t), the utterer distance determination section 105 determines whether the utterer is close to the user. The distance indicating that the utterer is close to the user corresponds to a distance of 2 [m] or less between the utterer and the user. However, the distance indicating that the utterer is close to the user is not limited to the distance of 2 [m] or less.

In the case that the level difference ΔLx(t) is equal to or more than a preset first threshold value β1, the utterer distance determination section 105 determines that the utterer is close to the user. The first threshold value β1 is 12 [dB] for example. Furthermore, in the case that the level difference ΔLx(t) is less than a preset second threshold value β2, the utterer distance determination section 105 determines that the utterer is far away from the user.

The second threshold value β2 is 8 [dB] for example. Furthermore, in the case that the level difference ΔLx(t) is equal to or more than the second threshold value β2 and less than the first threshold value β1, the utterer distance determination section 105 determines that the utterer is slightly away from the user.

In the case of ΔLx(t)≥β1, the utterer distance determination section 105 outputs distance determination result information "1" indicating that the utterer is close to the user to the gain derivation section 106. The distance determination result information "1" represents that the direct sound picked up by the first directional microphone 101 is abundant and that the reverberant sound picked up by the second directional microphone 102 is scarce.

In the case of ΔLx(t)<β2, the utterer distance determination section 105 outputs distance determination result information "−1" indicating that the utterer is far away from the user. The distance determination result information "−1" represents that the direct sound picked up by the first directional microphone 101 is scarce and that the reverberant sound picked up by the second directional microphone 102 is abundant.

In the case of β2≤ΔLx(t)<β1, the utterer distance determination section 105 outputs distance determination result information "0" indicating that the utterer is slightly away from the user.

Determining the distance of the utterer on the basis of only the magnitude of the level Lx1(*t*) calculated by the first level calculation section 103 is not efficient in the accuracy of the determination. Due to the characteristics of the first directional microphone 101, when only the magnitude of the level Lx1(*t*) is used, it is difficult to determine the difference between a case in which a person far away from the user speaks at high volume and a case in which a person close to the user speaks at normal volume.

The characteristics of the first and second directional microphones 101 and 102 are as described next. In the case that the utterer is close to the user, the sound signal x1(*t*) output from the first directional microphone 101 is relatively larger than the sound signal x2(*t*) output from the second directional microphone 102.

Furthermore, in the case that the utterer is far away from the user, the sound signal x1(*t*) output from the first directional microphone 101 is almost equal to the sound signal x2(*t*) output from the second directional microphone 102. In particular, in the case that the apparatus is used in a room with large reverberation, this tendency becomes significant.

For this reason, the utterer distance determination section 105 does not determine whether the utterer is close to or far away from the user on the basis of only the magnitude of the level Lx1(*t*) calculated by the first level calculation section 103. Hence, the utterer distance determination section 105 determines the distance of the utterer on the basis of the difference between the level Lx1(*t*) of the sound signal x1(*t*) in which the direct sound is mainly picked up and the level Lx2(*t*) of the sound signal x2(*t*) in which the reverberant sound is mainly picked up.

The gain derivation section 106 derives the gain α(t) corresponding to the sound signal x1(*t*) output from the first directional microphone 101 on the basis of the distance determination result information output from the utterer distance determination section 105. The gain derivation section 106 outputs the derived gain α(t) to the level control section 107.

Figure 4:
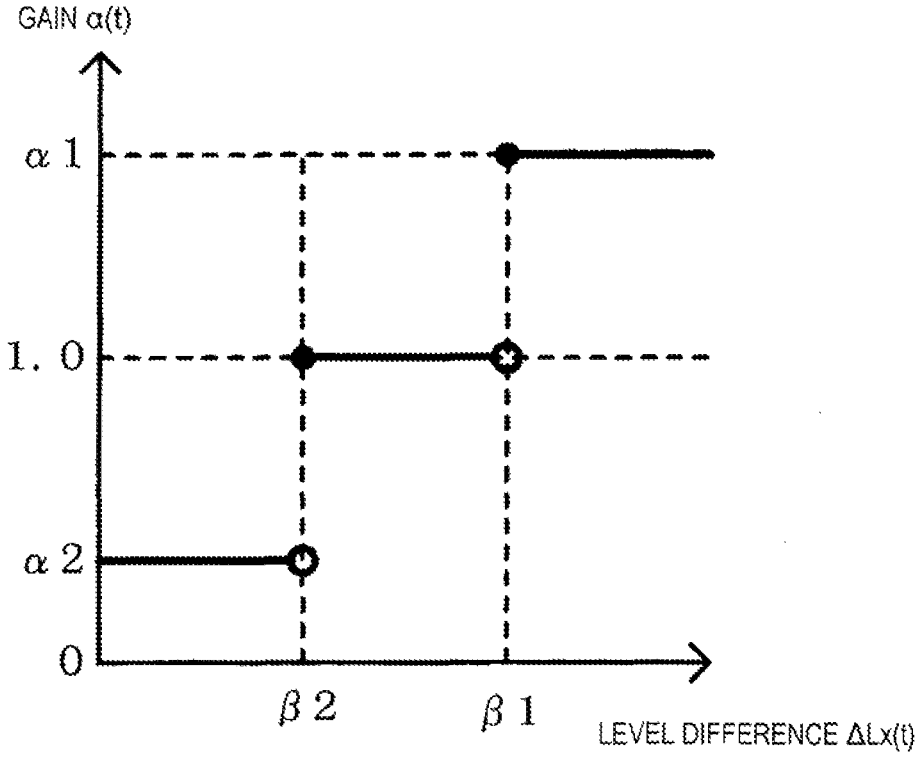
FIG. 4 is a view showing an example representing the relationship between the difference between the calculated levels and an installation gain.

The gain α(t) is determined on the basis of the distance determination result information or the level difference ΔLx(t). FIG. 4 is a view showing an example representing the relationship between the level difference ΔLx(t) calculated by the utterer distance determination section 105 and the gain α(t).

As shown in FIG. 4, in the case that the distance determination result information is "1", the utterer is close to the user and it is highly likely that the utterer is the conversational partner of the user; hence, a gain α1 is given as the gain α(t) corresponding to the sound signal x1(*t*). For example, when "2.0" is set as the gain α1, the sound signal x1(*t*) is relatively emphasized.

In addition, in the case that the distance determination result information is "−1", the utterer is far away from the user and it is less likely that the utterer is the conversational partner of the user; hence, a gain α2 is given as the gain α(t) corresponding to the sound signal x1(*t*). For example, when "0.5" is set as the gain α2, the sound signal x1(*t*) is relatively attenuated.

Furthermore, in the case that the distance determination result information is "0", the sound signal x1(*t*) is not particularly emphasized or attenuated; hence, "1.0" is given as the gain α(t).

The value derived as the gain α(t) in the above description is herein given as an instantaneous gain α'(t) to reduce the distortion that is generated in the sound signal x1(*t*) when the gain α(t) changes rapidly. The gain derivation section 106 finally calculates the gain α(t) according to Mathematical expression (4) described below. Furthermore, in Mathematical expression (4), $\tau_\alpha$ represents a time constant, has a value in the range of $0<\tau_\alpha\leq 1$ and has been determined in advance.

[Mathematical Expression 4]

$$\alpha(t)=\tau_\alpha\cdot\alpha'(t)+(1-\tau_\alpha)\cdot\alpha(t-1) \quad (4)$$

The level control section 107 obtains the gain α(t) derived according to Mathematical expression (4) described above by the gain derivation section 106 and the sound signal x1(*t*) output from the first directional microphone 101. The level control section 107 generates an output signal y(t) that is obtained by multiplying the gain α(t) derived by the gain derivation section 106 to the sound signal x1(*t*) output from the first directional microphone 101.

(The Operation of the Sound Processing Apparatus 10 According to the First Embodiment)

Figure 5:
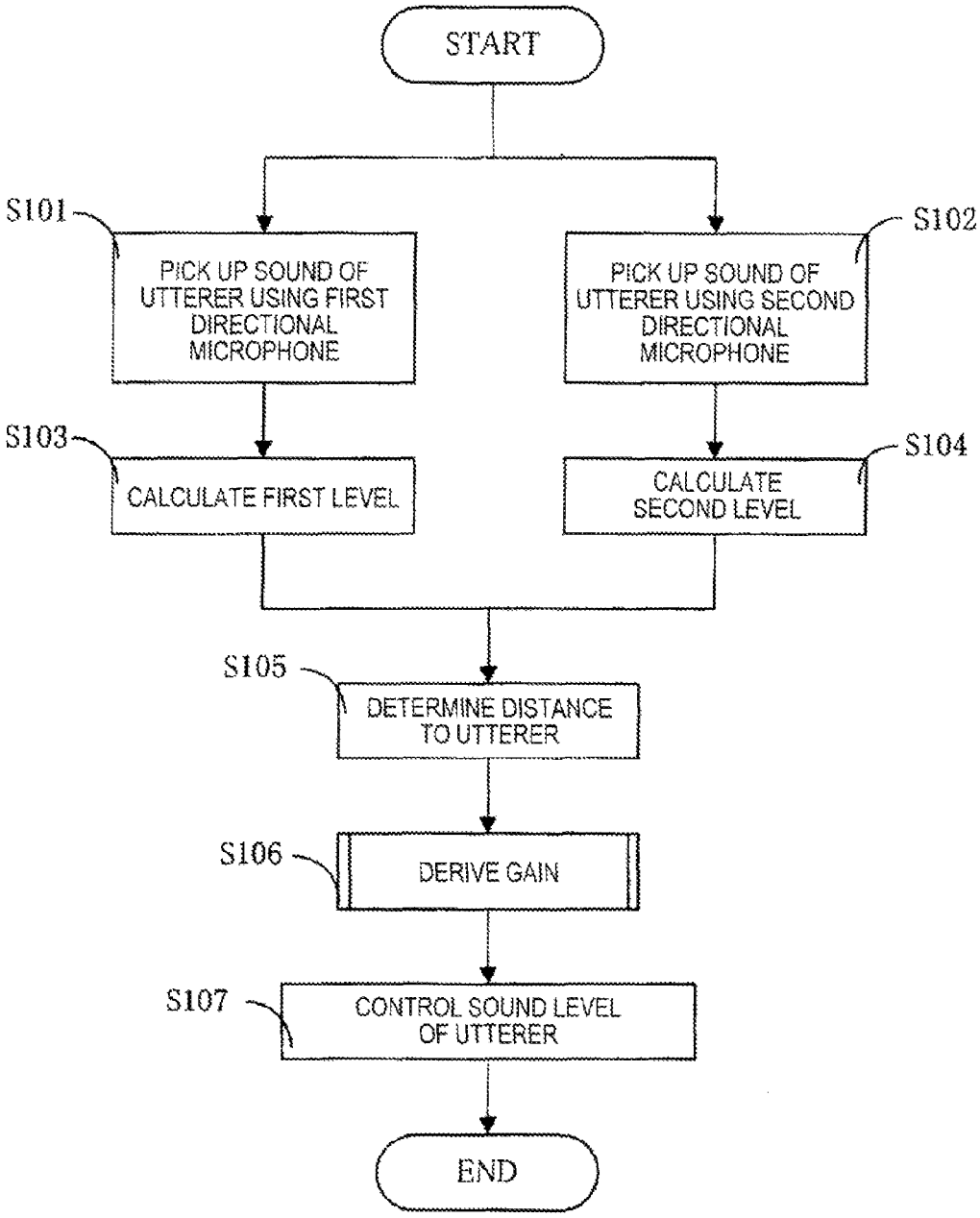
FIG. 5 is a flowchart illustrating the operation of the sound processing apparatus according to the first embodiment.

Next, the operation of the sound processing apparatus 10 according to the first embodiment will be described referring to FIG. 5. FIG. 5 is a flowchart illustrating the operation of the sound processing apparatus 10 according to the first embodiment.

The first directional microphone 101 picks up the direct sound of the sound of the utterer (at S101). Concurrently, the second directional microphone 102 picks up the reverberant sound of the sound of the utterer (at S102). The respective sound pickup processes of the first directional microphone 101 and the second directional microphone 102 are performed at the same timing.

The first directional microphone 101 outputs the picked-up sound signal x1(*t*) to each of the first level calculation section 103 and the level control section 107. In addition, the second directional microphone 102 outputs the picked-up sound signal x2(*t*) to the second level calculation section 104.

The first level calculation section 103 obtains the sound signal x1(*t*) output from the first directional microphone 101 and calculates the level Lx1(*t*) of the obtained sound signal x1(*t*) (at S103). Concurrently, the second level calculation section 104 obtains the sound signal x2(*t*) output from the second directional microphone 102 and calculates the level Lx2(*t*) of the obtained sound signal x2 (at S104).

The first level calculation section 103 outputs the calculated level Lx1(*t*) to the utterer distance determination section 105. Furthermore, the second level calculation section 104 outputs the calculated level Lx2(*t*) to the utterer distance determination section 105.

The utterer distance determination section 105 obtains the level Lx1(*t*) calculated by the first level calculation section 103 and the level Lx2(*t*) calculated by the second level calculation section 104.

The utterer distance determination section 105 determines whether the utterer is close to the user on the basis of the level difference ΔLx(t) between the level Lx1(*t*) and the level Lx2(*t*) obtained as described above (at S105). The utterer distance determination section 105 outputs the distance determination result information serving as the result of the determination to the gain derivation section 106.

The gain derivation section 106 obtains the distance determination result information output from the utterer distance determination section 105. The gain derivation section 106 derives the gain α(t) corresponding to the sound signal x1(*t*) output from the first directional microphone 101 on the basis of the distance determination result information output from the utterer distance determination section 105 (at S106).

The details of the derivation of the gain α(t) will be described later. The gain derivation section 106 outputs the derived gain α(t) to the level control section 107.

The level control section 107 obtains the gain α(t) derived from the gain derivation section 106 and the sound signal x1(*t*) output from the first directional microphone 101. The level control section 107 generates the output signal y(t) that is obtained by multiplying the gain α(t) derived by the gain derivation section 106 to the sound signal x1(*t*) output from the first directional microphone 101 (at S107).

(The Details of the Gain Deriving Process)

Figure 6:
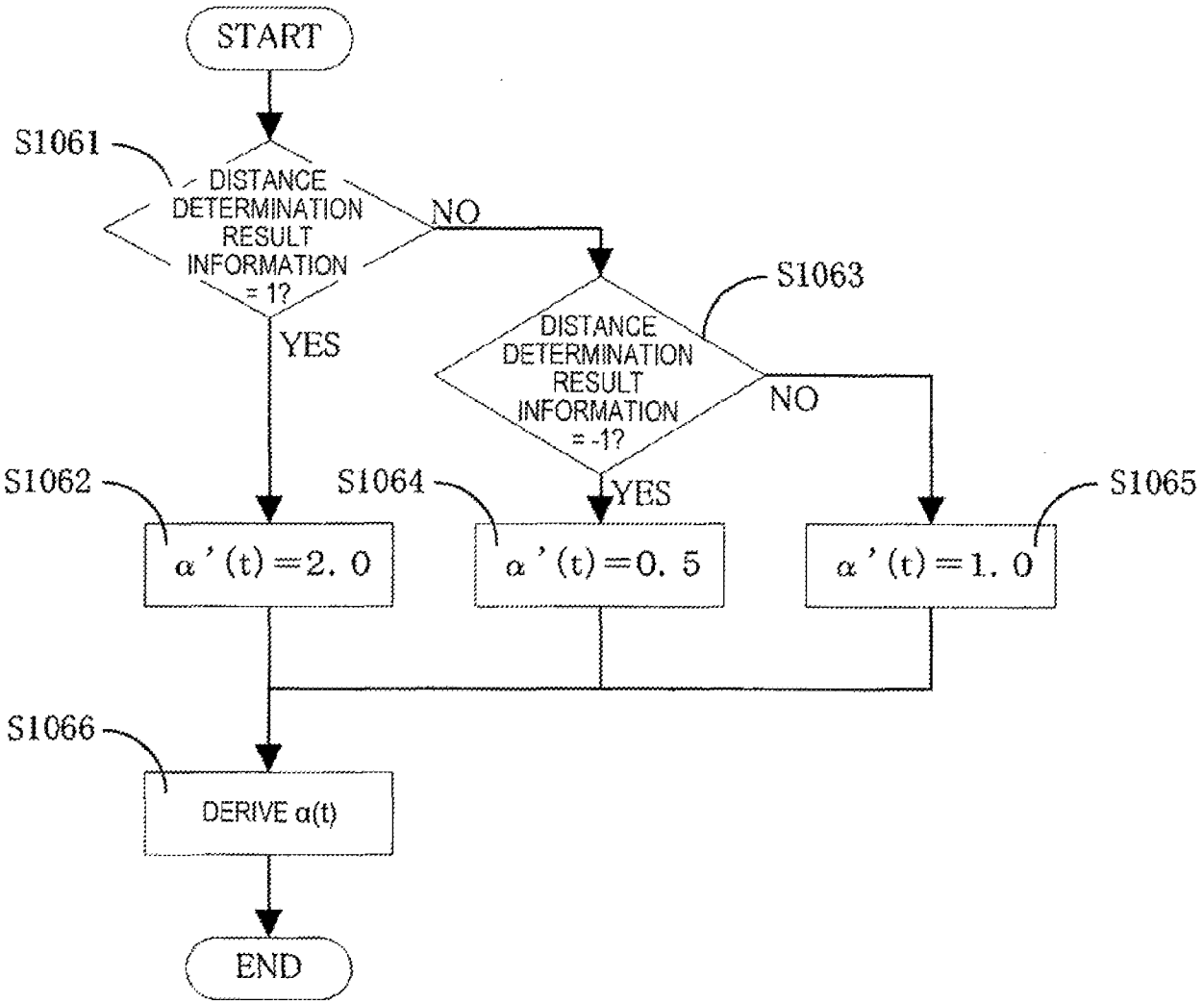
FIG. 6 is a flowchart illustrating the gain derivation section process by the gain derivation section of the sound processing apparatus according to the first embodiment.

The details of the process for deriving the gain α(t) corresponding to the sound signal x1(*t*) will be described referring to FIG. 6 on the basis of the distance determination result information output from the utterer distance determination section 105. FIG. 6 is a flowchart illustrating the details of the operation of the gain derivation section 106.

In the case that the distance determination result information is "1", that is, in the case of the level difference ΔLx≥β1 (YES at S1061), "2.0" is derived as the instantaneous gain α'(t) corresponding to the sound signal x1(*t*) (at S1062). In the case that the distance determination result information is "−1", that is, in the case of the level difference ΔLx<β2 (YES at S1063), "0.5" is derived as the instantaneous gain α'(t) corresponding to the sound signal x1(*t*) (at S1064).

In the case that the distance determination result information is "0", that is, in the case of β2≤the level difference ΔLx<β1 (NO at S1063), "1.0" is derived as the instantaneous gain α'(t) (at S1065). After the instantaneous gain α'(t) is derived, the gain derivation section 106 calculates the gain α(t) according to Mathematical expression (4) described above (at S1066).

As described above, in the sound processing apparatus according to the first embodiment, the determination as to whether the utterer is close to or far away from the user is made even in the case that the first and second directional microphones being disposed at a distance of approximately several [mm] to several [cm] therebetween are used. More specifically, in this embodiment, the distance of the utterer is determined according to the magnitude of the level difference ΔLx(t) between the sound signals x1(*t*) and x2(*t*) picked up respectively by the first and second directional microphones being disposed at a distance of approximately several [mm] to several [cm] therebetween.

The gain calculated according to the result of the determination is multiplied to the sound signal output to the first directional microphone for picking up the direct sound of the utterer, and the level is controlled.

Hence, the sound of the utterer close to the user, such as the conversational partner thereof, is emphasized; conversely, the sound of the utterer far away from the user is attenuated or suppressed. As a result, only the sound of the conversational partner close to the user can be emphasized so as to be heard clearly and efficiently, regardless of the distance between the microphones.

Second Embodiment

Figure 7:
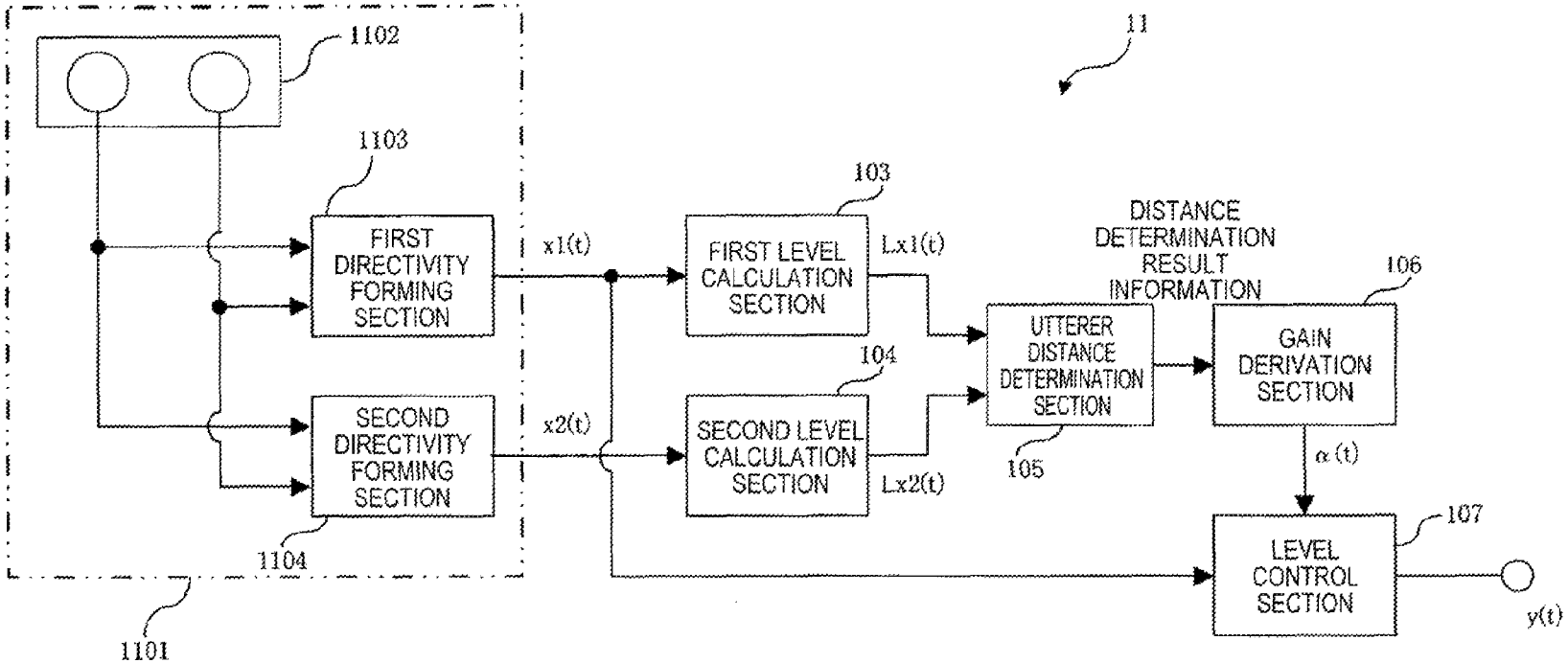
FIG. 7 is a block diagram showing an internal configuration of a sound processing apparatus according to a second embodiment.

FIG. 7 is a block diagram showing an internal configuration of a sound processing apparatus 11 according to a first embodiment. In FIG. 7, the same components as those shown in FIG. 1 are designated by the same reference codes and the descriptions of the components are omitted. As shown in FIG. 7, the sound processing apparatus 11 has a directional sound pickup section 1101, the first level calculation section 103, the second level calculation section 104, the utterer distance determination section 105, the gain derivation section 106, and the level control section 107.

(The Internal Configuration of the Sound Processing Apparatus 11 According to the Second Embodiment)

As shown in FIG. 7, the directional sound pickup section 1101 has a microphone array 1102, a first directivity forming section 1103, and a second directivity forming section 1104.

The microphone array 1102 is an array in which a plurality of omnidirectional microphones are disposed. The configuration shown in FIG. 7 is an example in which an array is formed of two omnidirectional microphones. The distance D between the two omnidirectional microphones is a given value that is determined by restrictions in the required frequency band and installation space. The distance D is herein assumed to be in the range of D=5 mm to 30 mm in view of the frequency band.

The first directivity forming section 1103 forms directivity having the main axis of directivity in the direction of the utterer by using the sound signals output from the two omnidirectional microphones of the microphone array 1102 and mainly picks up the direct sound of the sound of the utterer. The first directivity forming section 1103 outputs the sound signal x1(*t*), the directivity of which has been formed, to each of the first level calculation section 103 and the level control section 107.

The second directivity forming section 1104 forms directivity having the dead zone of directivity in the direction of the utterer by using the sound, signals output from the two omnidirectional microphones of the microphone array 1102. Next, the second directivity forming section 1104 does not pick up the direct sound of the sound of the utterer but picks up the reverberant sound of the sound of the utterer mainly generated by the reflection from the wall or the like of a room. The second directivity forming section 1104 outputs the sound signal x2(*t*), the directivity of which has been formed, to the second level calculation section 104.

Figure 8:
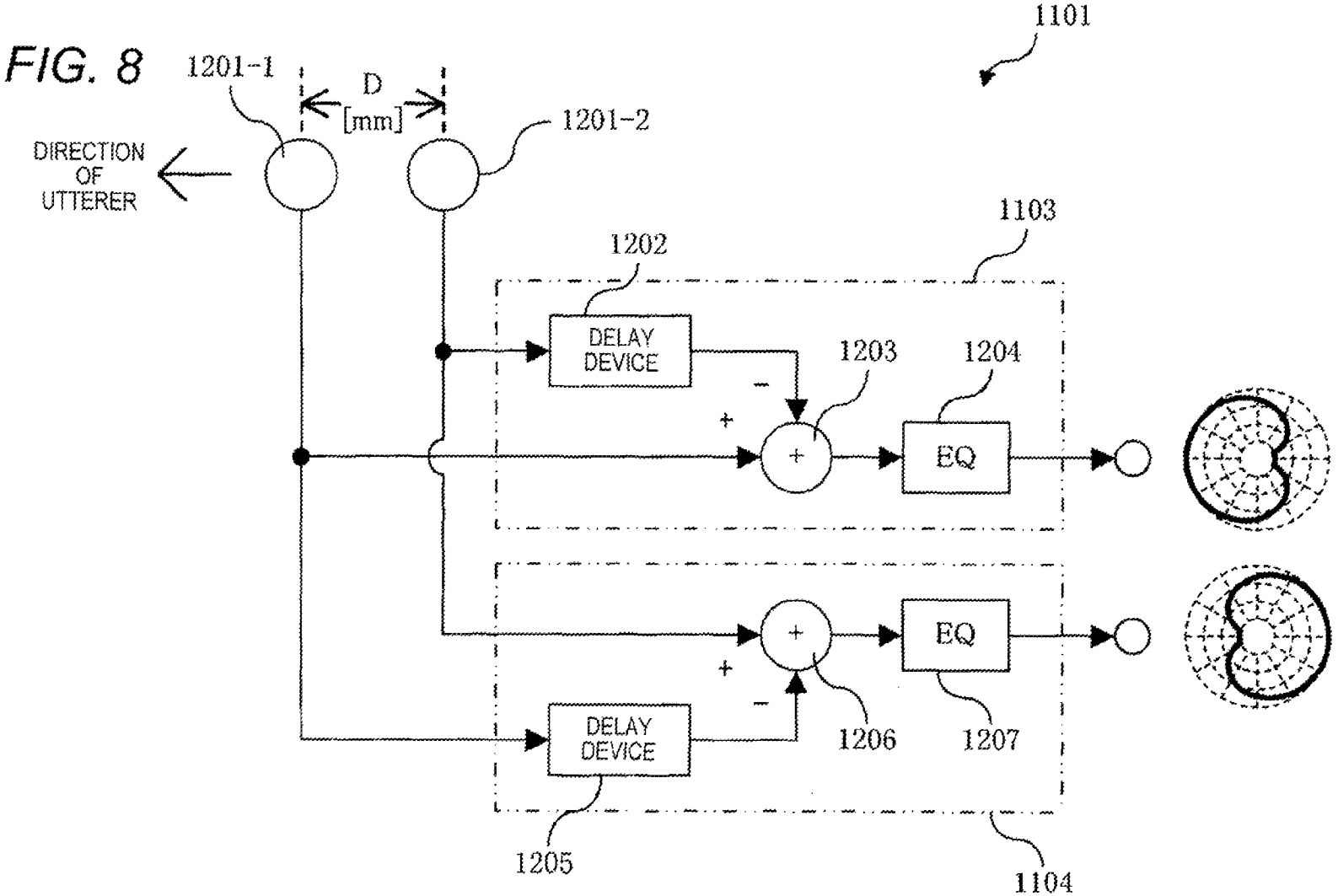
FIG. 8 is a block diagram showing internal configurations of first and second directivity forming sections.

A sound pressure gradient type or an addition type is generally used as a directivity forming method. An example of directivity forming will herein be described referring to FIG. 8. FIG. 8 is a block diagram showing an internal configuration of the directional sound pickup section 1101 shown in FIG. 7 and illustrating the directivity forming method of the sound pressure gradient type. As shown in FIG. 8, two omnidirectional microphones 1201-1 and 1201-2 are used for the microphone array 1102.

The first level calculation section 1103 is formed of a delay device 1202, an arithmetic unit 1203, and an EQ 1204.

The delay device 1202 obtains the sound signal output from the omnidirectional microphone 1201-2 and delays the obtained sound signal by a predetermined amount. The amount of the delay by the delay device 1202 is, for example, a value corresponding to a delay time D/c [s] wherein the distance between the microphones is D [m] and the speed of sound is c [m/s]. The delay device 1202 outputs the sound signal delayed by the predetermined amount to the arithmetic unit 1203.

The arithmetic unit 1203 obtains the sound signal output from the omnidirectional microphone 1201-1 and the sound signal delayed by the delay device 1202. The arithmetic unit 1203 calculates the difference obtained by subtracting the sound signal delayed by the delay device 1202 from the sound signal output from the omnidirectional microphone 1201-1 and outputs the calculated sound signal to the EQ 1204.

The equalizer EQ 1204 mainly compensates for the low frequency band of the sound signal output from the arithmetic unit 1203. The difference between the sound signal output from the omnidirectional microphone 1201-1 and the sound signal delayed by the delay device 1202 is, made small in the low frequency band by the arithmetic unit 1203. Hence, the EQ 1204 is inserted to flatten the frequency characteristics in the direction of the utterer.

The second directivity forming section 1104 is formed of a delay device 1205, an arithmetic unit 1206, and an EQ 1207. The input signals in the second directivity forming section 1104 are opposite to those in the first directivity forming section 1103.

The delay device 1205 obtains the sound signal output from the omnidirectional microphone 1201-1 and delays the obtained sound signal by a predetermined amount. The amount of the delay of the delay device 1205 is, for example, a value corresponding to a delay time D/c [s] wherein the distance between the microphones is D [m] and the speed of sound is c [m/s]. The delay device 1205 outputs the sound signal delayed by the predetermined amount to the arithmetic unit 1206.

The arithmetic unit 1206 obtains the sound signal output from the omnidirectional microphone 1201-2 and the sound signal delayed by the delay device 1205. The arithmetic unit 1206 calculates the difference between the sound signal output from the omnidirectional microphone 1201-2 and the sound signal delayed by the delay device 1205 and outputs the calculated sound signal to the EQ 1207.

The equalizer EQ 1207 mainly compensates for the low frequency band of the sound signal output from the arithmetic unit 1206. The difference between the sound signal output from the omnidirectional microphone 1201-2 and the sound signal delayed by the delay device 1205 is made small in the low frequency band by the arithmetic unit 1206. Hence, the EQ 1207 is inserted to flatten the frequency characteristics in the direction of the utterer.

The first level calculation section 103 obtains the sound signal x1($t$) output from the first directivity forming section 1103 and calculates the level Lx1($t$) [dB] of the obtained sound signal x1($t$) according to Mathematical expression (1) described above. The first level calculation section 103 outputs the level Lx1($t$) of the calculated sound signal x1($t$) to the utterer distance determination section 105.

In Mathematical expression (1) described above, N is the number of samples required for the level calculation. For example, in the case that the sampling frequency is 8 [kHz] and that the analysis time for level calculation is 20 [ms], the number N of samples becomes N=160.

In addition, $\tau$ represents a time constant, has a value in the range of $0<\tau\leq 1$ and has been determined in advance. As the time constant $\tau$, for the purpose of promptly following the rising of sound, a small time constant is used in the case that the relationship represented by Mathematical expression (2) described above is established.

On the other hand, in the case that the relationship represented by Mathematical expression (2) is not established (Mathematical expression (3) described above), a large time constant is used to reduce the lowering of the level in the consonant sections of sound or between the phrases of sound.

Figure 9:
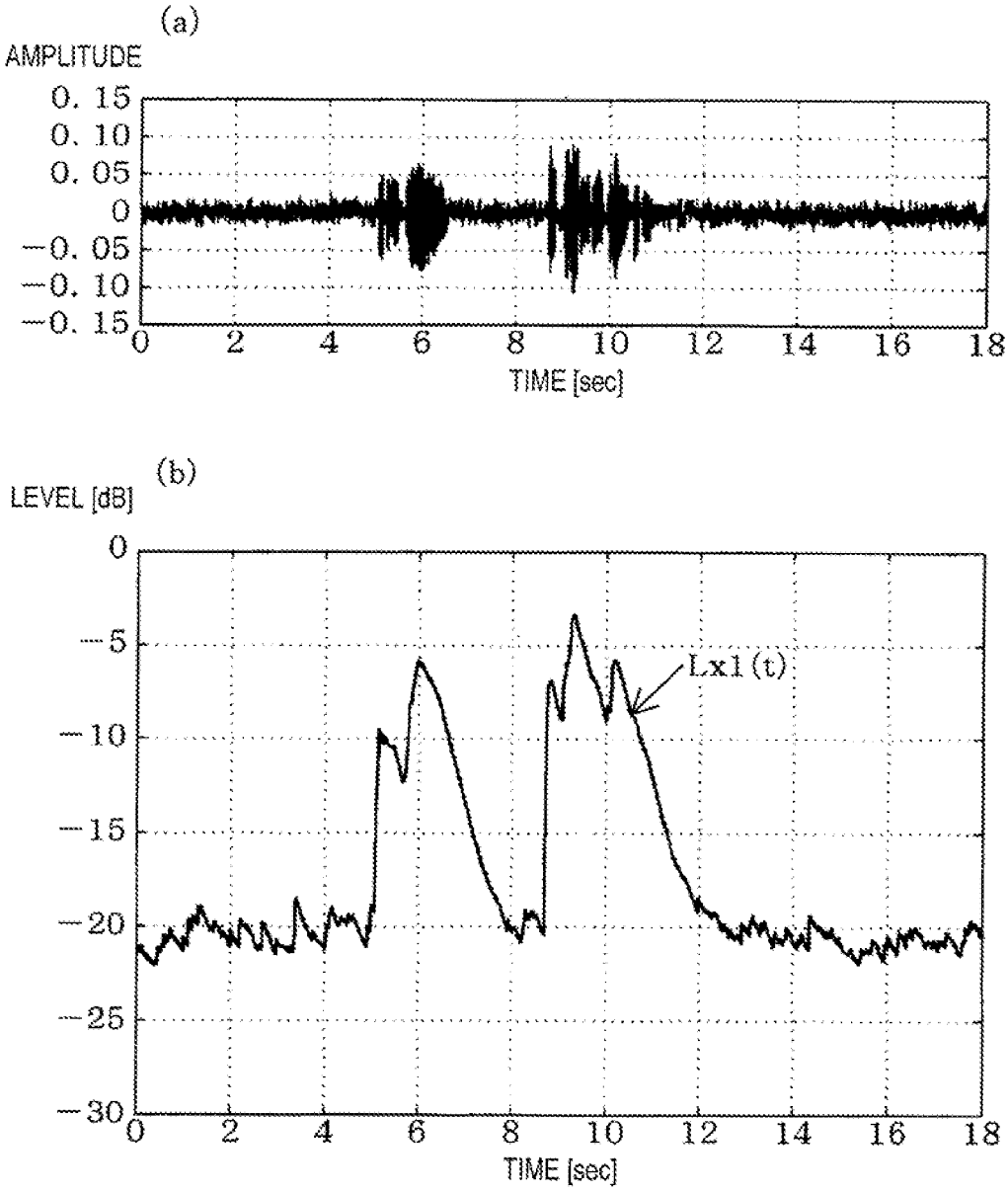
FIG. 9 is a view showing an example of the time change in the sound waveform output from the first directivity forming section and a view showing an example of the time change in the level calculated by a first level calculation section; (a) is a view showing the time change in the sound waveform output from the first directivity forming section, and (b) is a view showing the time change in the level calculated by the first level calculation section.

FIG. 9 shows the waveform of the sound output from the first directivity forming section 1103 and the level Lx1($t$) obtained when the first level calculation section 103 performed calculation. The calculated level Lx1($t$) is an example obtained by the first level calculation section 103 in the case that the time constant in Mathematical expression (2) described above is 100 [ms] and that the time constant in Mathematical expression (3) described above is 400 [ms].

FIG. 9($a$) is a view showing the time change in the waveform of the sound output from the first directivity forming section 1103, and FIG. 9($b$) is a view showing the time change in the level calculated by the first level calculation section 103. In FIG. 9($a$), the vertical axis represents amplitude, and the horizontal axis represents time [sec]. In FIG. 9($b$), the vertical axis represents level, and the horizontal axis represents time [sec].

The second level calculation section 104 obtains the sound signal x2($t$) output from the second directivity forming section 1104 and calculates the level Lx2($t$) of the obtained sound signal x2($t$). The second level calculation section 104 outputs the calculated level Lx2($t$) of the sound signal x2($t$) to the utterer distance determination section 105. The calculation expression of the level Lx2($t$) calculated by the second level calculation section 104 is the same as Mathematical expression (1) by which the level Lx1($t$) is calculated.

Figure 10:
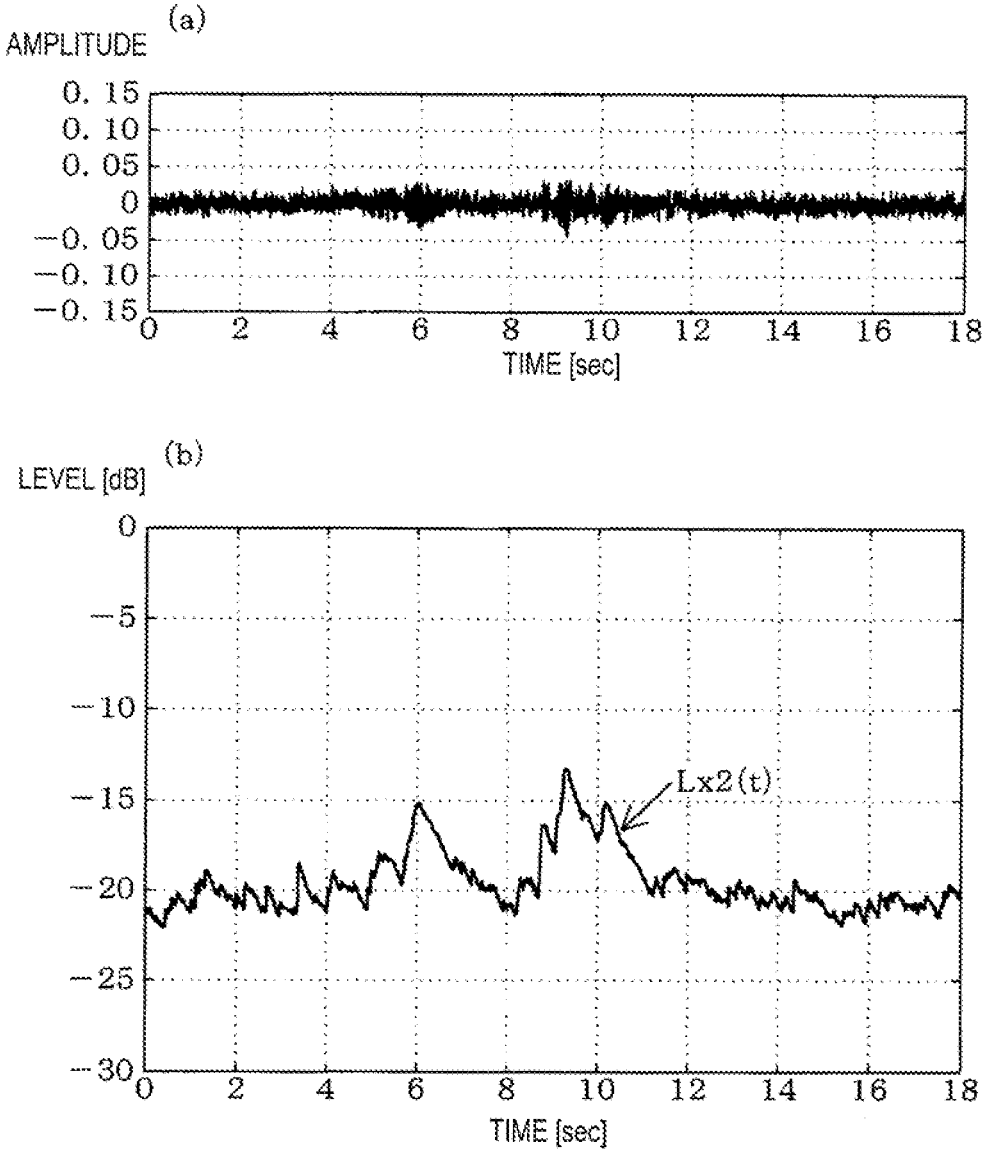
FIG. 10 is a view showing an example of the time change in the sound waveform output from the second directivity forming section and a view showing an example of the time change in the level calculated by a second level calculation section; (a) is a view showing the time change in the sound waveform output from the second directivity forming section, and (b) is a view showing the time change in the level calculated by the second level calculation section.

FIG. 10 shows the waveform of the sound output from the second directivity forming section 1104 and the level Lx2($t$) obtained when calculation is performed by the second level calculation section 104. The calculated level Lx2($t$) is an example obtained by the second level calculation section 104 in the case that the time constant in Mathematical expression (2) described above is 100 [ms] and that the time constant in Mathematical expression (3) described above is 400 [ms].

FIG. 10($a$) is a view showing the time change in the waveform of the sound output from the second directivity forming section 1104. Furthermore, FIG. 10($b$) is a view showing the time change in the level calculated by the second level calculation section 104. In FIG. 10($a$), the vertical axis represents amplitude, and the horizontal axis represents time [sec]. In FIG. 10($b$), the vertical axis represents level, and the horizontal axis represents time [sec].

The utterer distance determination section 105 obtains the level Lx1($t$) of the sound signal x1($t$) calculated by the first level calculation section 103 and the level Lx2($t$) of the sound signal x2($t$) calculated by the second level calculation section 103. On the basis of these obtained level Lx1($t$) and level Lx2($t$), the utterer distance determination section 105 determines whether the utterer is close to the user. The utterer distance determination section 105 outputs distance determination result information serving as the result of the determination to the gain derivation section 106.

More specifically, to the utterer distance determination section 105, the level Lx1($t$) of the sound signal x1($t$) calculated by the first level calculation section 103 and the level Lx2($t$) of the sound signal x2($t$) calculated by the second level calculation section 104 are input. Next, the utterer distance determination section 105 calculates the level difference ΔLx (t)=Lx1($t$)−Lx2($t$) serving as the difference between the level Lx1($t$) of the sound signal x1($t$) and the level Lx2($t$) of the sound signal x2($t$).

On the basis of the calculated level difference ΔLx(t), the utterer distance determination section 105 determines whether the utterer is close to the user. The distance indicating that the utterer is close to the user corresponds to a distance of 2 [m] or less between the utterer and the user. However, the distance indicating that the utterer is close to the user is not limited to the distance of 2 [m] or less.

In the case that the level difference ΔLx(t) is equal to or more than the preset first threshold value β1, the utterer distance determination section 105 determines that the utterer is close to the user. The first threshold value β1 is 12 [dB] for example. Furthermore, in the case that the level difference ΔLx(t) is less than the preset second threshold value β2, the utterer distance determination section 105 determines that the utterer is far away from the user.

The second threshold value β2 is 8 [dB] for example. Furthermore, in the case that the level difference ΔLx(t) is equal to or more than the second threshold value β2 and less than the first threshold value β1, the utterer distance determination section 105 determines that the utterer is slightly away from the user.

Figure 11:
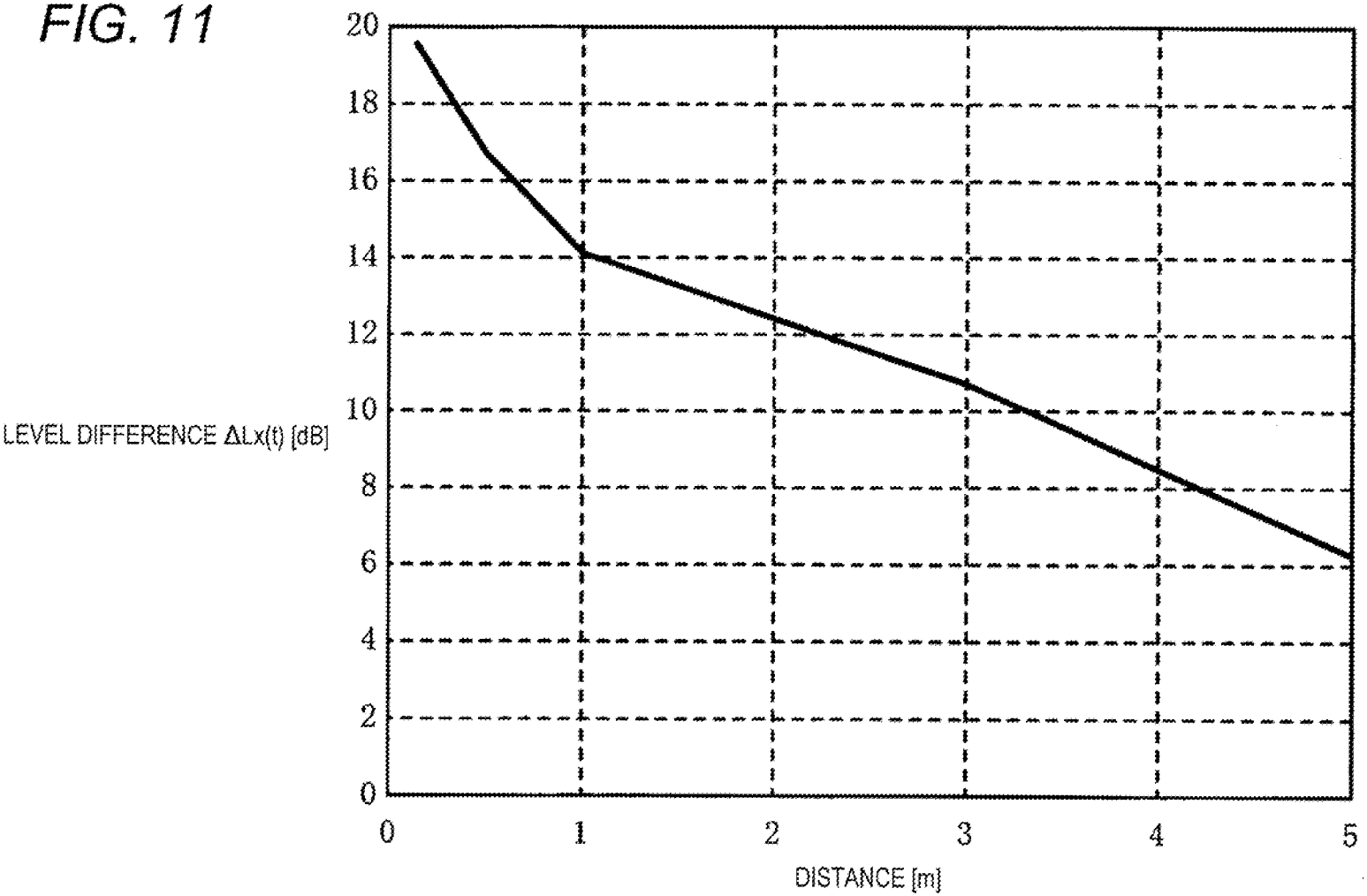
FIG. 11 is a view showing an example of the relationship between the distance to an utterer and the level difference between the level calculated by the first level calculation section and the level calculated by the second level calculation section.

As an example, FIG. 11 is a graph showing the relationship between the level difference ΔLx(t) calculated by the above-mentioned method and the distance between the user and the utterer by using data picked up by the actual two omnidirectional microphones. According to FIG. 11, it is possible to confirm that the level difference ΔLx(t) lowers as the utterer becomes far away from the user. Furthermore, in the case that the first threshold value β1 and the second threshold value β2 are set to the above-mentioned values (β1=12 [dB], β2=8 [dB]), respectively, the sound of the utterer with a distance of approximately 2 [m] or less can be emphasized, and the sound of the utterer with a distance of approximately 4 [m] or more can be attenuated.

In the case of ΔLx(t)≥β1, the utterer distance determination section 105 outputs the distance determination result information "1" indicating that the utterer is close to the user to the gain derivation section 106. The distance determination result information "1" represents that the direct sound picked up by the first directivity forming section 1103 is abundant and that the reverberant sound picked up by the second directivity forming section 1104 is scarce.

In the case of ΔLx(t)<β2, the utterer distance determination section 105 outputs the distance determination result information "−1" indicating that the utterer is far away from the user. The distance determination result information "−1" represents that the direct sound picked up by the first directivity forming section 1103 is scarce and that the reverberant sound picked up by the second directivity forming section 1104 is abundant.

In the case of β2≤ΔLx(t)<β1, the utterer distance determination section 105 outputs the distance determination result information "0" indicating that the utterer is slightly away from the user.

Determining the distance of the utterer on the basis of only the magnitude of the level Lx1($t$) calculated by the first level calculation section 103 is not efficient in the accuracy of the determination, as in the first embodiment. Due to the characteristics of the first directivity forming section 1103, when only the magnitude of the level Lx1($t$) is used, it is difficult to determine the difference between a case in which a person far away from the user speaks at high volume and a case in which a person close to the user speaks at normal volume.

The characteristics of the first and second directivity forming sections 1103 and 1104 are as described next. In the case that the utterer is close to the user, the sound signal x1($t$) output from the first directivity forming section 1103 is relatively larger than the sound signal x2($t$) output from the second directivity forming section 1104.

Furthermore, in the case that the utterer is far away from the user, the sound signal x1($t$) output from the first directivity forming section 1103 is almost equal to the sound signal x2($t$) output from the second directivity forming section 1104. In particular, in the case that the apparatus is used in a room with large reverberation, this tendency becomes significant.

For this reason, the utterer distance determination section 105 does not determine whether the utterer is close to or far away from the user on the basis of only the magnitude of the level Lx1($t$) calculated by the first level calculation section 103. Hence, the utterer distance determination section 105 determines the distance of the utterer on the basis of the difference between the level Lx1($t$) of the sound signal x1($t$) in which the direct sound is mainly picked up and the level Lx2($t$) of the sound signal x2($t$) in which the reverberant sound is mainly picked up.

The gain derivation section 106 derives the gain α(t) corresponding to the sound signal x1($t$) output from the first directivity forming section 1103 on the basis of the distance determination result information output from the utterer distance determination section 105. The gain derivation section 106 outputs the derived gain α(t) to the level control section 107.

The gain α(t) is determined on the basis of the distance determination result information or the level difference ΔLx (t). The relationship between the level difference ΔLx(t) calculated by the utterer distance determination section 105 and the gain α(t) is the same as the relationship shown in FIG. 4 in the first embodiment.

As shown in FIG. 4, in the case that the distance determination result information is "1", the utterer is close to the user and it is highly likely that the utterer is the conversational partner of the user; hence, the gain α1 is given as the gain α(t) corresponding to the sound signal x1($t$). For example, when "2.0" is set as the gain α1, the sound signal x1($t$) is relatively emphasized.

In addition, in the case that the distance determination result information is "−1", the utterer is far away from the user and it is less likely that the utterer is the conversational partner of the user; hence, the gain α2 is given as the gain α(t) corresponding to the sound signal x1($t$). When "0.5" is set as the gain α2 for example, the sound signal x1($t$) is relatively attenuated.

Furthermore, in the case that the distance determination result information is "0", the sound signal x1($t$) is not particularly emphasized or attenuated; hence, "1.0" is given as the gain α(t).

The value derived as the gain α(t) in the above description is herein given as the instantaneous gain α'(t) to reduce the distortion that is generated in the sound signal x1($t$) when the gain α(t) changes rapidly. The gain derivation section 106 calculates the gain α(t) according to Mathematical expression (4) described above. Furthermore, in Mathematical expression (4), $\tau\alpha$ represents a time constant, has a value in the range of $0<\tau_\alpha\leq 1$ and has been determined in advance.

The level control section 107 obtains the gain $\alpha(t)$ derived according to Mathematical expression (4) described above by the gain derivation section 106 and the sound signal x1(*t*) output from the first directivity forming section 1103. The level control section 107 generates an output signal y(t) that is obtained by multiplying the gain $\alpha(t)$ derived by the gain derivation section 106 to the sound signal x1(*t*) output from the first directivity forming section 1103.

(The Operation of the Sound Processing Apparatus 11 According to the Second Embodiment)

Figure 12:
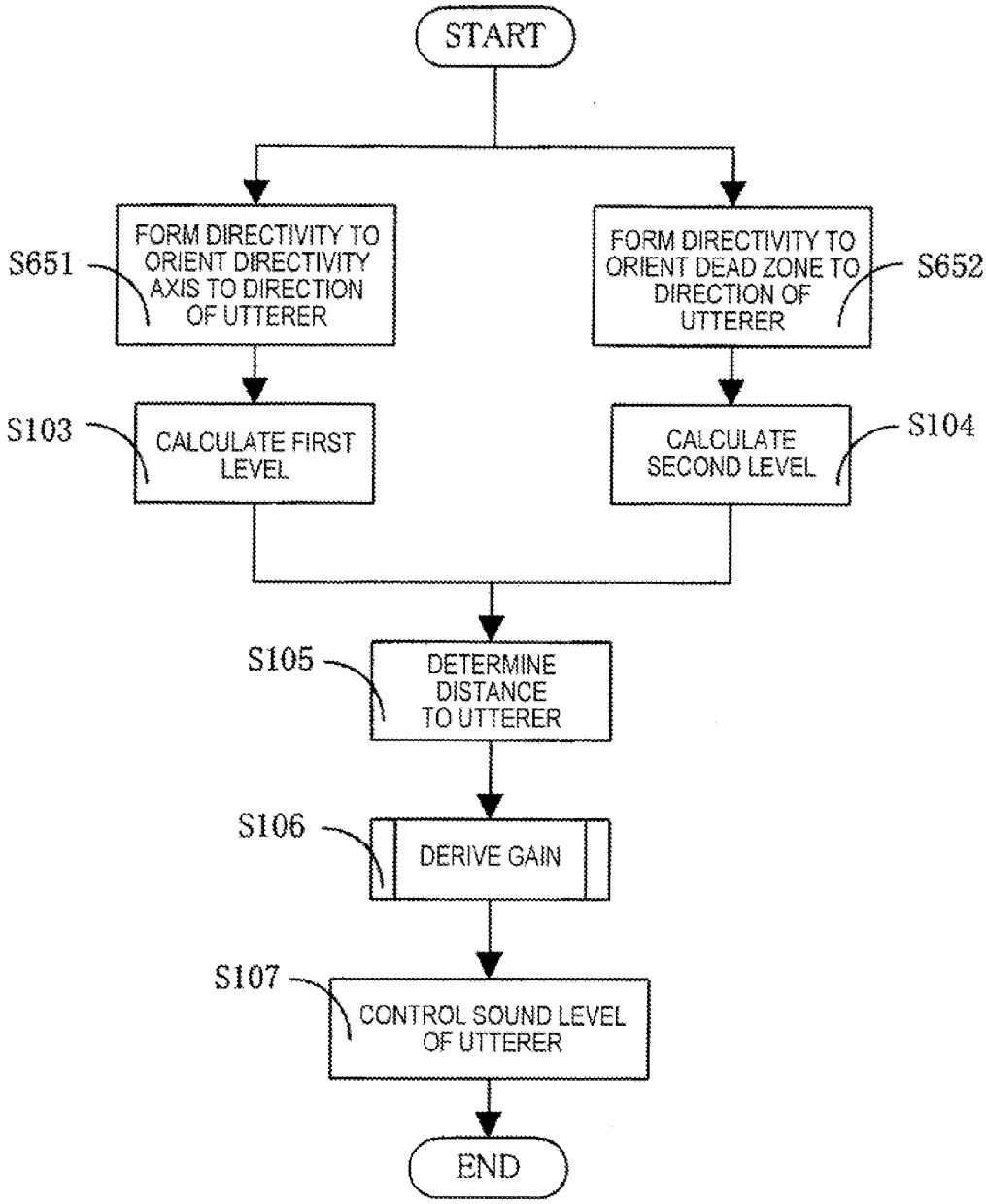
FIG. 12 is a flowchart illustrating the operation of the sound processing apparatus according to the first embodiment.

Next, the operation of the sound processing apparatus 11 according to the second embodiment will be described referring to FIG. 12. FIG. 12 is a flowchart illustrating the operation of the sound processing apparatus 11 according to the second embodiment.

The first directivity forming section 1103 forms the directivity regarding the direct sound component from the utterer with respect to the sound signals respectively output from the microphone array 1102 of the directional sound pickup section 1101 (at S651). The first directivity forming section 1103 outputs a sound signal, the directivity of which has been formed, to each of the first level calculation section 103 and the level control section 107.

Concurrently, the second directivity forming section 1104 forms the directivity regarding the reverberant sound component from the utterer with respect to the sound signals respectively output from the microphone array 1102 of the directional sound pickup section 1101 (at S652). The second directivity forming section 1104 outputs a sound signal, the directivity of which has been formed, to the second level calculation section 104.

The first level calculation section 103 obtains the sound signal x1(*t*) output from the first directivity forming section 1103 and calculates the level Lx1(*t*) of the obtained sound signal x1(*t*) (at S103). Concurrently, the second level calculation section 104 obtains the sound signal x2(*t*) output from the second directivity forming section 1104 and calculates the level Lx2(*t*) of the obtained sound signal x2 (at S104).

The first level calculation section 103 outputs the calculated level Lx1(*t*) to the utterer distance determination section 105. Furthermore, the second level calculation section 104 outputs the calculated level Lx2(*t*) to the utterer distance determination section 105.

The utterer distance determination section 105 obtains the level Lx1(*t*) calculated by the first level calculation section 103 and the level Lx2(*t*) calculated by the second level calculation section 104.

The utterer distance determination section 105 determines whether the utterer is close to the user on the basis of the level difference $\Delta$Lx(t) between the level Lx1(*t*) and the level Lx2(*t*) obtained as described above (at S105). The utterer distance determination section 105 outputs the distance determination result information serving as the result of the determination to the gain derivation section 106.

The gain derivation section 106 obtains the distance determination result information output from the utterer distance determination section 105. The gain derivation section 106 derives the gain $\alpha(t)$ corresponding to the sound signal x1(*t*) output from the first directivity forming section 1103 on the basis of the distance determination result information output from the utterer distance determination section 105 (at S106).

The details of the derivation of the gain $\alpha(t)$ have been described referring to FIG. 6 in the first embodiment and thus the descriptions thereof are omitted. The gain derivation section 106 outputs the derived gain $\alpha(t)$ to the level control section 107.

The level control section 107 obtains the gain $\alpha(t)$ derived from the gain derivation section 106 and the sound signal x1(*t*) output from the first directivity forming section 1103. The level control section 107 generates the output signal y(t) that is obtained by multiplying the gain $\alpha(t)$ derived by the gain derivation section 106 to the sound signal x1(*t*) output from the first directivity forming section 1103 (at S107).

As described above, in the sound processing apparatus according to the second embodiment, sound pickup is performed by the microphone array in which a plurality of omnidirectional microphones are disposed at a distance of approximately several [mm] to several [cm] therebetween. Next, in the apparatus, it is determined whether the utterer is close to or far away from the user according to the magnitude of the level difference $\Delta$Lx(t) between the sound signals x1(*t*) and x2(*t*), the directivities of which have been formed by the first and second directivity forming sections.

The gain calculated according to the result of the determination is multiplied to the sound signal output to the first directivity forming section for picking up the direct sound of the utterer, and the level is controlled.

Hence, in the second embodiment, the sound of the utterer close to the user, such as the conversational partner thereof, is emphasized; conversely, the sound of the utterer far away from the user is attenuated or suppressed. As a result, only the sound of the conversational partner close to the user can be emphasized so as to be heard clearly and efficiently, regardless of the distance between the microphones.

Furthermore, in the second embodiment, sharp directivity can be formed in the direction of the utterer by increasing the number of the omnidirectional microphones constituting the microphone array, whereby the distance of the utterer can be determined highly accurately.

Third Embodiment

Figure 13:
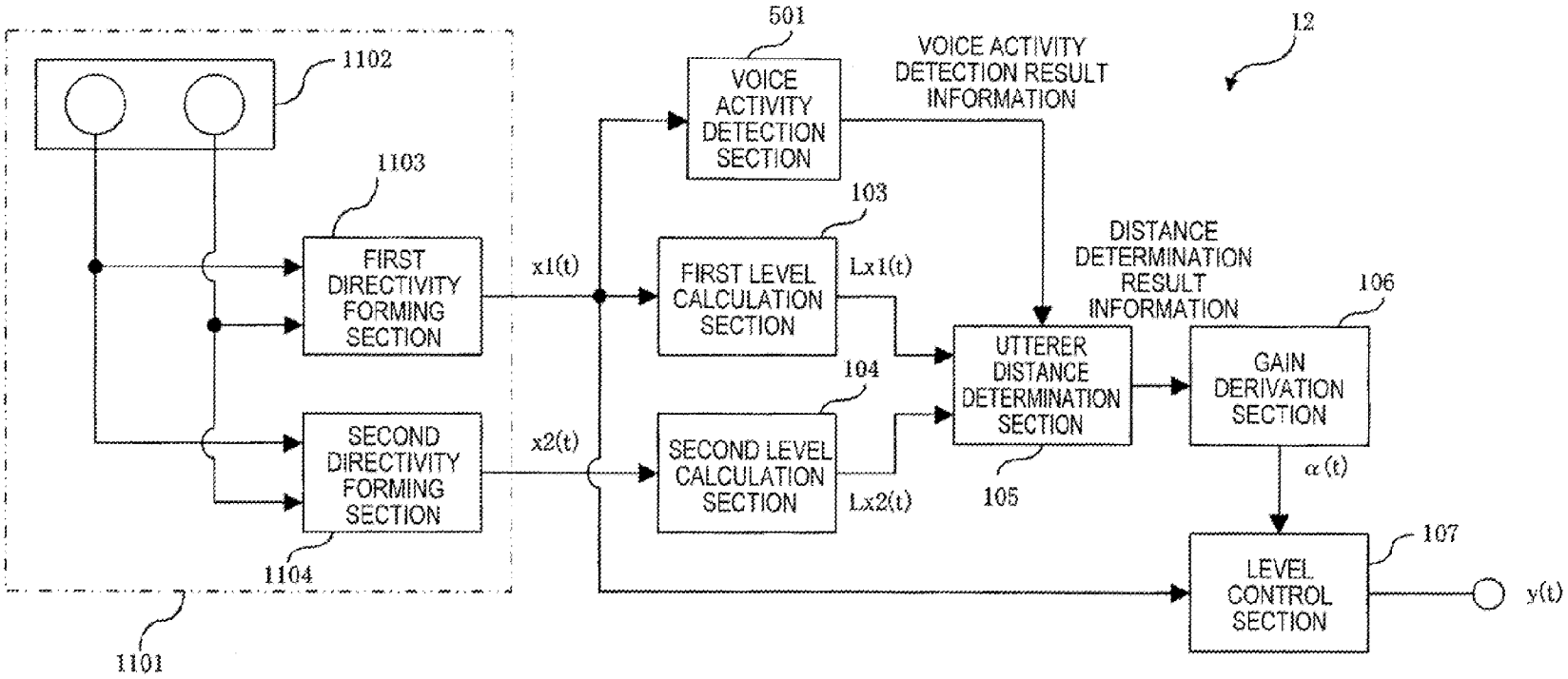
FIG. 13 is a block diagram showing an internal configuration of a sound processing apparatus according to a second embodiment.

FIG. 13 is a block diagram showing an internal configuration of a sound processing apparatus 12 according to a third embodiment. The sound processing apparatus 12 according to the third embodiment is different from the sound processing apparatus 11 according to the second embodiment in that the apparatus further has a component, that is, a voice activity detection section 501 as shown in FIG. 13. In FIG. 13, the same components as those shown in FIG. 7 are designated by the same reference codes and the descriptions of the components are omitted.

(The Internal Configuration of the Sound Processing Apparatus 12 According to the Third Embodiment)

The voice activity detection section 501 obtains the sound signal x1(*t*) output from the first directivity forming section 1103. By using the sound signal x1(*t*) output from the first directivity forming section 1103, the voice activity detection section 501 detects an interval in which the utterer, excluding the user of the sound processing apparatus 12, produces sound. The voice activity detection section 501 outputs this detected voice activity detection result information to the utterer distance determination section 105.

Figure 14:
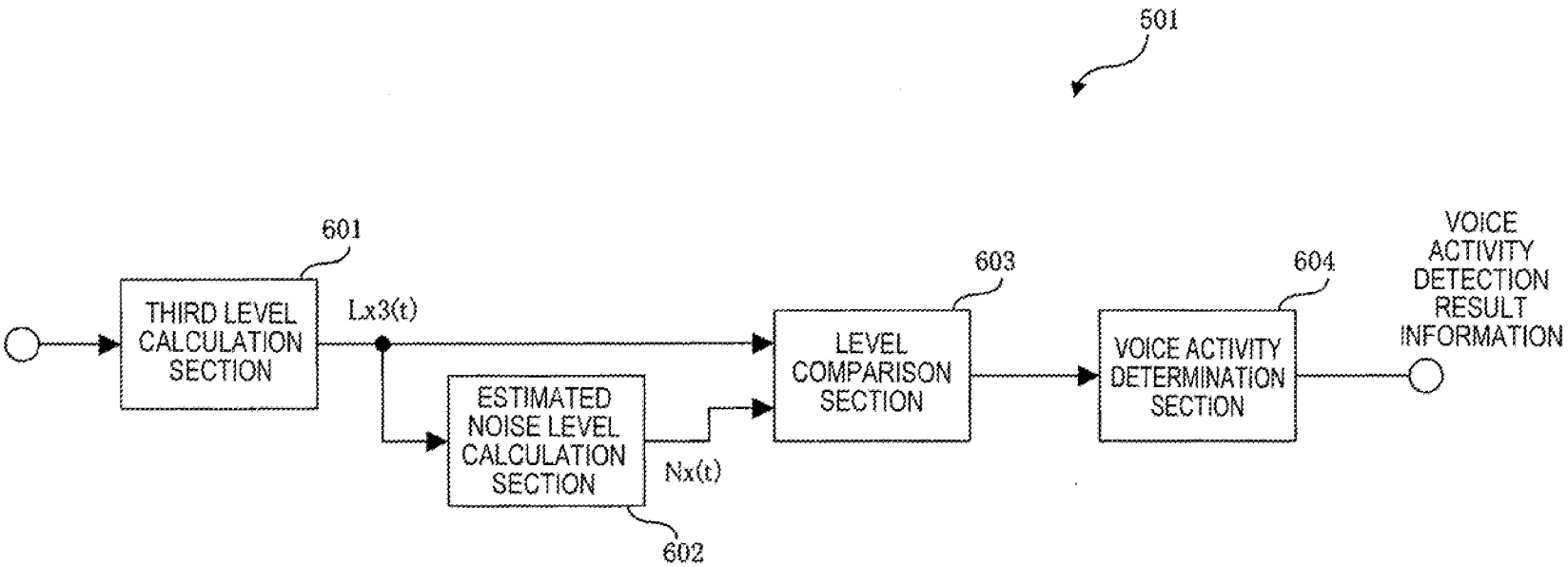
FIG. 14 is a block diagram showing an internal configuration of the voice activity detection section of the sound processing apparatus according to the second embodiment.

FIG. 14 is a block diagram showing an example of an internal configuration of the voice activity detection section 501. As shown in FIG. 14, the voice activity detection section 501 has a third level calculation section 601, an estimated noise level calculation section 602, a level comparison section 603, and a voice activity determination section 604.

The third level calculation section 601 calculates the level Lx3($t$) of the sound signal x1($t$) output from the first directivity forming section 1103 according to Mathematical expression (1) described above. The level Lx1($t$) of the sound signal x1($t$) calculated by the first level calculation section 103, instead of the level Lx3($t$), may be input to each of the estimated noise level calculation section 602 and the level comparison section 603.

In this case, the voice activity detection section 501 is not required to have the third level calculation section 601, and Lx3($t$)=Lx1($t$) should only be obtained. The third level calculation section 601 outputs the calculated level Lx3($t$) to each of the estimated noise level calculation section 602 and the level comparison section 603.

The estimated noise level calculation section 602 obtains the level Lx3($t$) output from the third level calculation section 601. The estimated noise level calculation section 602 calculates the estimated noise level Nx(t) [dB] for the obtained level Lx3($t$). Mathematical expression (5) represents an example of an expression for calculating the estimated noise level Nx(t) that is calculated by the estimated noise level calculation section 602.

[Mathematical expression 5]

$$Nx(t)=10\log_{10}(\tau_N\cdot 10^{Lx3(t)/10}+(1-\tau_N)\cdot 10^{Nx(t-1)/10}) \quad (5)$$

In Mathematical expression (5), $\tau_N$ is a time constant, has a value in the range of $0<\tau_N\leq 1$ and has been determined in advance. When Lx3($t$)>Nx(t−1), a large time constant is used as the time constant $\tau_N$ so that the estimated noise level Nx(t) does not rise in the speech interval. The estimated noise level calculation section 602 outputs the calculated estimated noise level Nx(t) to the level comparison section 603.

The level comparison section 603 obtains each of the estimated noise level Nx(t) calculated by the estimated noise level calculation section 602 and the level Lx3($t$) calculated by the third level calculation section 601. The level comparison section 603 compares the level Lx3($t$) with the noise level Nx(t) and outputs the comparison result information obtained by the comparison to the voice activity determination section 604.

The voice activity determination section 604 obtains the comparison result information output from the level comparison section 603. On the basis of the obtained comparison result information, the voice activity determination section 604 determines an interval in which the utterer produces sound for the sound signal x1($t$) output from the first directivity forming section 1103. The voice activity determination section 604 outputs the voice activity detection result information serving as the voice activity detection result having been determined as the speech interval to the utterer distance determination section 105.

In the comparison between the level Lx3($t$) and the estimated noise level Nx(t), the level comparison section 603 outputs an interval in which the difference between the level Lx3($t$) and the estimated noise level Nx(t) is equal to or more than a third threshold value βN as a "speech interval" to the voice activity determination section 604.

The third threshold value βN is 6 [dB] for example. Furthermore, the level comparison section 603 compares the level Lx3($t$) with the estimated noise level Nx(t) and outputs an interval in which the difference therebetween is less than the third threshold value βN as a "no-speech interval" to the voice activity determination section 604.

Figure 15:
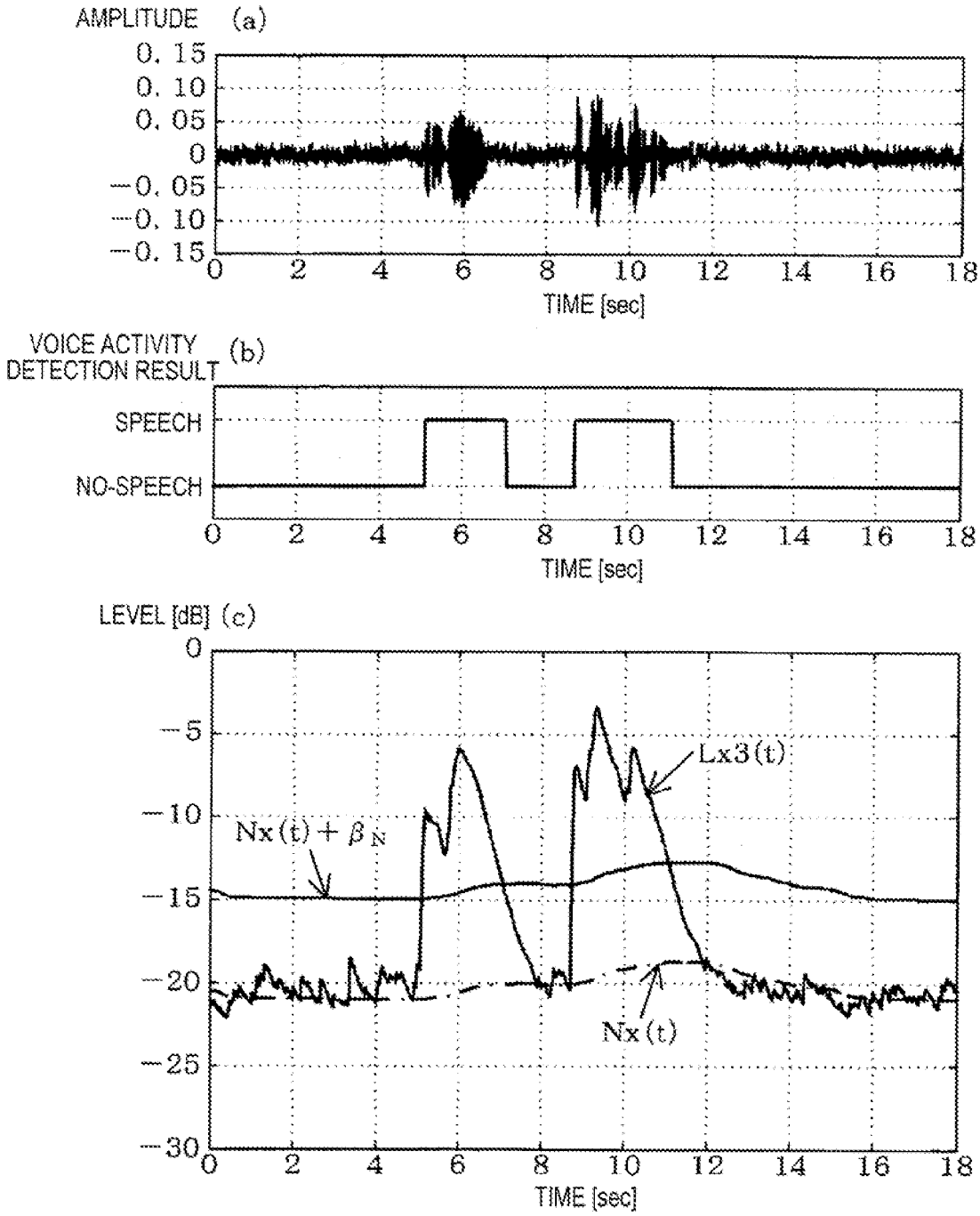
FIG. 15 is a view showing the time change in the waveform of the sound signal output from the first directivity forming section, a view showing the time change in the detection result from the voice activity detection section and a view showing the time change in the result of the comparison between the level calculated by a third level calculation section and an estimated noise level; (a) is a view showing the time change in the waveform of the sound signal output from the first directivity forming section, and (b) is a view showing the time change in the voice activity detection result detected by the voice activity detection section, and (c) is a view showing the comparison, by the voice activity detection section, between the level of the waveform of the sound signal output from the first directivity forming section and the estimated noise level calculated by the voice activity detection section.

The voice activity detection result obtained by the voice activity detection section 501 will be described referring to FIG. 15. FIG. 15 is a view showing the time change in the waveform of the sound signal output from the first directivity forming section 1103, a view showing the time change in the detection result obtained by the voice activity determination section 604, and a view showing the time change in the result of the comparison between the level calculated by the third level calculation section 601 and the estimated noise level.

FIG. 15($a$) is a view showing the time change in the waveform of the sound signal x1($t$) output from the first directivity forming section 1103. In FIG. 15($a$), the vertical axis represents amplitude, and the horizontal axis represents time [sec].

FIG. 15($b$) is a view showing the time change in the voice activity detection result detected by the voice activity determination section 604. In FIG. 15($b$), the vertical axis represents voice activity detection result, and the horizontal axis represents time [sec].

FIG. 15($c$) is a view showing the comparison between the level Lx3($t$) and the estimated noise level Nx(t) with respect to the waveform of the sound signal x1($t$) output from the first directivity forming section 1103. In FIG. 15($c$), the vertical axis represents level, and the horizontal axis represents time [sec].

In FIG. 15($c$), an example is shown in which the time constant in the case of Lx3($t$)≤Nx(t−1) is 1 [sec] and the time constant in the case of Lx3($t$)>Nx(t−1) is 120 [sec]. FIG. 15($b$) and FIG. 15($c$) show the level Lx3($t$), the noise level Nx(t), (Nx(t)+βN) in the case that the third threshold value βN is 6 [dB], and the sound detection result.

The utterer distance determination section 105 obtains the voice activity detection result information output from the voice activity determination section 604 of the voice activity detection section 501. On the basis of the obtained voice activity detection result information, the utterer distance determination section 105 determines whether the utterer is close to the user only in the voice activity detected by the voice activity detection section 501. The utterer distance determination section 105 outputs the distance determination result information obtained by the determination to the gain derivation section 106.

(The Operation of the Sound Processing Apparatus 12 According to the Third Embodiment)

Figure 16:
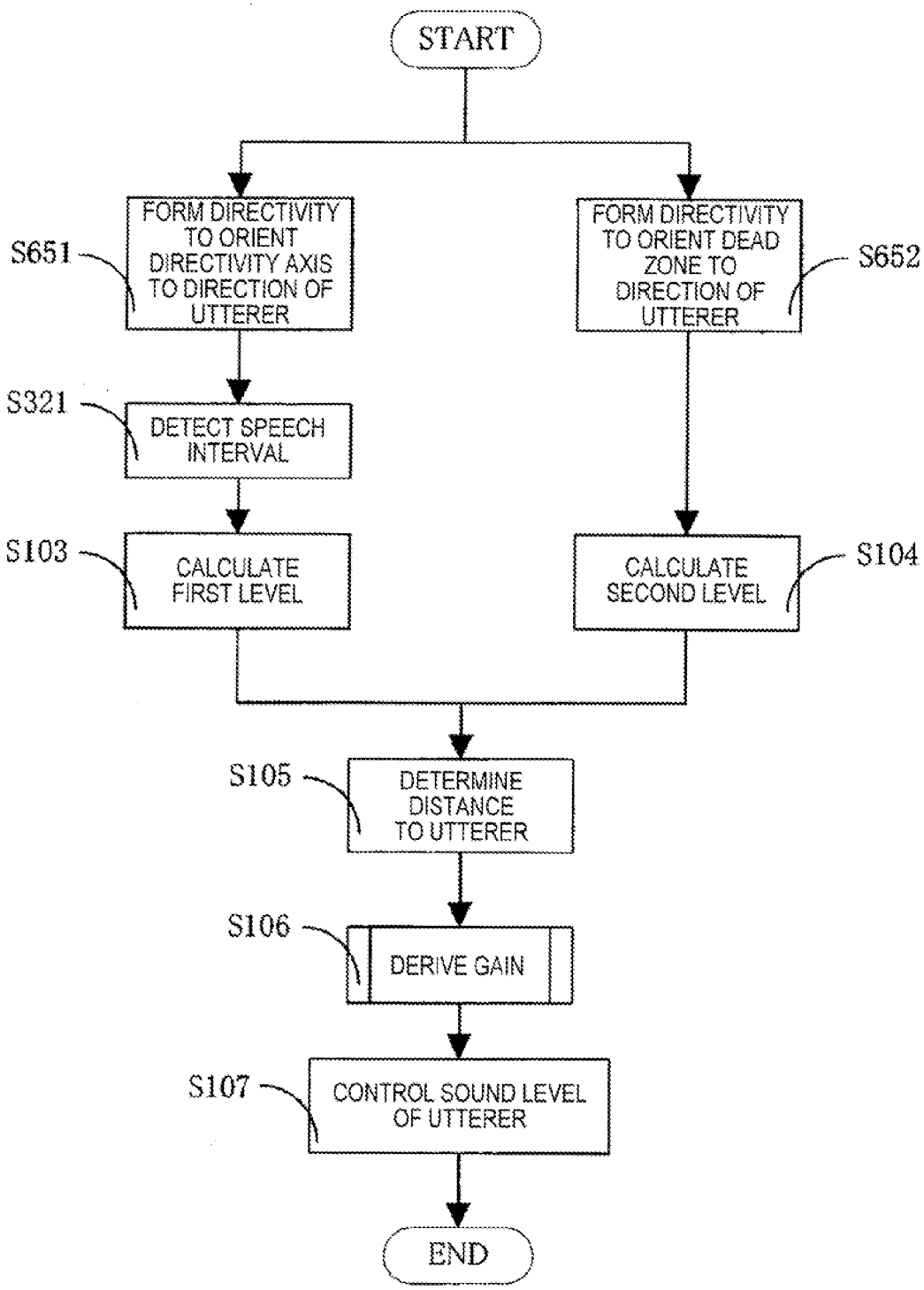
FIG. 16 is a flowchart illustrating the operation of the sound processing apparatus according to the second embodiment.

Next, the operation of the sound processing apparatus 12 according to the third embodiment will be described referring to FIG. 16. FIG. 16 is a flowchart illustrating the operation of the sound processing apparatus 12 according to the third embodiment. In FIG. 16, the description of the same operation as the operation of the sound processing apparatus 11 according to the second embodiment shown in FIG. 12 is omitted, and the processes relating to the above-mentioned components will mainly be described.

The first directivity forming section 1103 outputs the sound signal x1($t$) formed at step S651 to each of the voice activity detection section 501 and the level control section 107. The voice activity detection section 501 obtains the sound signal x1($t$) output from the first directivity forming section 1103.

The voice activity detection section 501 detects an interval in which the utterer produces sound using the sound signal x1($t$) output from the first directivity forming section 1103 (at S321). The voice activity detection section 501 outputs the detected voice activity detection result information to the utterer distance determination section 105.

In the process of the voice activity detection, the third level calculation section 601 calculates the level Lx3($t$) of the sound signal x1($t$) output from the first directivity forming section 1103 according to Mathematical expression (1) described above. The third level calculation section 601 outputs the calculated level Lx3(*t*) to each of the estimated noise level calculation section 602 and the level comparison section 603.

The estimated noise level calculation section 602 obtains the level Lx3(*t*) output from the third level calculation section 601. The estimated noise level calculation section 602 calculates the estimated noise level Nx(t) corresponding to the obtained level Lx3(*t*). The estimated noise level calculation section 602 outputs the calculated estimated noise level Nx(t) to the level comparison section 603.

The level comparison section 603 obtains each of the estimated noise level Nx(t) calculated by the estimated noise level calculation section 602 and the level Lx3(*t*) calculated by the third level calculation section 601. The level comparison section 603 compares the level Lx3(*t*) with the noise level Nx(t) and outputs the comparison result information obtained by the comparison to the voice activity determination section 604.

The voice activity determination section 604 obtains the comparison result information output from the level comparison section 603. On the basis of the obtained comparison result information, the voice activity determination section 604 determines an interval in which the utterer produces sound for the sound signal x1(*t*) output from the first directivity forming section 1103. The voice activity determination section 604 outputs the voice activity detection result information serving as the voice activity detection result having been determined as the voice activity to the utterer distance determination section 105.

The utterer distance determination section 105 obtains the voice activity detection result information output from the voice activity determination section 604 of the voice activity detection section 501. The utterer distance determination section 105 determines whether the utterer is close to the user only in the voice activity detected by the voice activity detection section 501 on the basis of the obtained voice activity detection result information (at S105). The details of the following processes are the same as those in the second embodiment (refer to FIG. 12) and the descriptions thereof are omitted.

As described above, in the sound processing apparatus according to the third embodiment, the voice activity of the sound signal formed by the first directivity forming section is detected by the voice activity detection section 501 added to the internal configuration of the sound processing apparatus according to the second embodiment. Only in the detected speech interval, it is determined whether the utterer is close to or far away from the user. The gain calculated according to the result of the determination is multiplied to the sound signal output to the first directivity forming section for picking up the direct sound of the utterer, and the level is controlled.

Hence, the sound of the utterer close to the user, such as the conversational partner thereof, is emphasized; conversely, the sound of the utterer far away from the user is attenuated or suppressed. As a result, only the sound of the conversational partner close to the user is emphasized so as to be heard clearly and efficiently, regardless of the distance between the microphones. Furthermore, since the distance to the utterer is determined only in the speech interval of the sound signal x1(*t*) output from the first directivity forming section, the distance to the utterer can be determined highly accurately.

Fourth Embodiment

Figure 17:
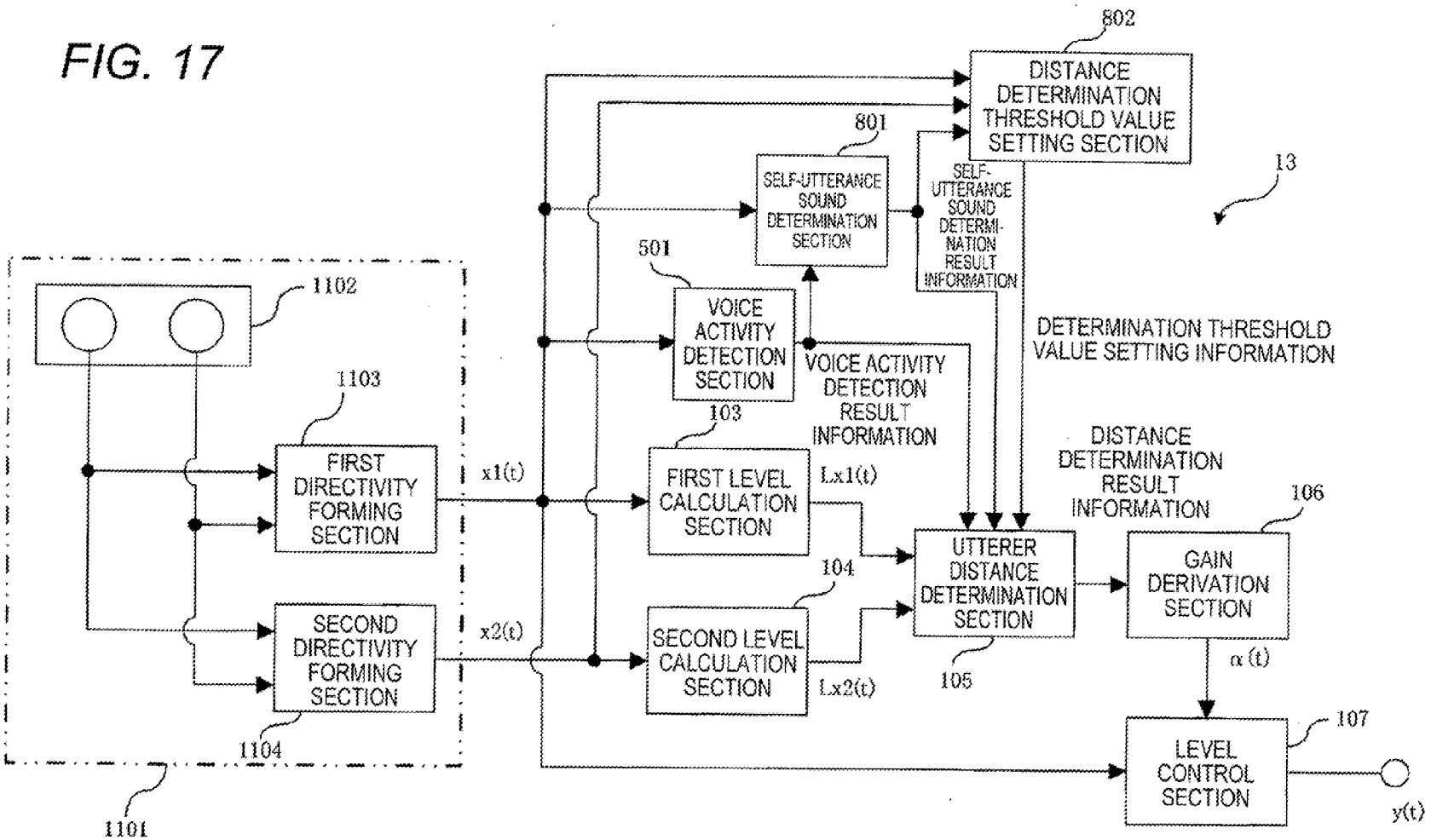
FIG. 17 is a block diagram showing an internal configuration of a sound processing apparatus according to a third embodiment.

FIG. 17 is a block diagram showing an internal configuration of a sound processing apparatus 13 according to a fourth embodiment. The fourth processing apparatus 13 according to the fourth embodiment is different from the sound processing apparatus 12 according to the third embodiment in that the apparatus further has components, that is, a self-utterance sound determination section 801 and a distance determination threshold value setting section 802 as shown in FIG. 17.

In FIG. 17, the same components as those shown in FIG. 13 are designated by the same reference codes and the descriptions thereof are omitted. Furthermore, in the following descriptions, self-utterance sound represents the sound produced by the user wearing a hearing aid equipped with the sound processing apparatus 13 according to the fourth embodiment.

(The Internal Configuration of the Sound Processing Apparatus 13 According to the Fourth Embodiment)

The voice activity detection section 501 obtains the sound signal x1(*t*) output from the first directivity forming section 1103. By using the sound signal x1(*t*) output from the first directivity forming section 1103, the voice activity detection section 501 detects an interval in which the user of the sound processing apparatus 13 or the utterer produces sound.

The voice activity detection section 501 outputs this detected voice activity detection result information to each of the utterer distance determination section 105 and the self-utterance sound determination section 801. The specific components of the voice activity detection section 501 are the same as the components shown in FIG. 14.

The self-utterance sound determination section 801 obtains the voice activity detection result information output from the voice activity detection section 501. The self-utterance sound determination section 801 determines whether the sound detected by the voice activity detection section 501 is self-utterance sound by using the absolute sound pressure level of the level Lx3(*t*) in the voice activity based on the obtained voice activity detection result information.

Since the mouth of the user serving as the sound source of the self-utterance sound is close to the user's ear in which the first directivity forming section 1103 is disposed; hence, the absolute sound pressure level of the self-utterance sound picked up by the first directivity forming section 1103 is high. In the case that the level Lx3(*t*) is equal to or more than a fourth threshold value β4, the self-utterance sound determination section 801 determines that the sound corresponding to the level Lx3(*t*) as self-utterance sound.

The fourth threshold value β4 is 74 [dB(SPL)] for example. The self-utterance sound determination section 801 outputs the self-utterance sound determination result information corresponding to the result of the determination to each of the distance determination threshold value setting section 802 and the utterer distance determination section 105.

At the time of the utterer distance determination by the utterer distance determination section 105, the self-utterance sound is input to the ear of the user at a more than necessary level in some cases; this is undesirable from the viewpoint of protecting the ear of the user. For this reason, in the case that the sound corresponding to the level Lx3(*t*) is determined as self-utterance sound, the self-utterance sound determination section 801 outputs "0" or "−1" as the self-utterance sound determination result information.

In other words, it is desirable that the self-utterance sound itself should not be level-controlled by the level control section 107 from the viewpoint of protecting the ear of the user.

The distance determination threshold value setting section 802 obtains the self-utterance sound determination information output from the self-utterance sound determination section 801. The distance determination threshold value setting section 802 eliminates the direct sound component contained in the sound signal x2(*t*) by using the sound signals x1(*t*) and x2(t) in the voice activity having been determined as self-utterance sound by the self-utterance sound determination section 801.

Figure 18:
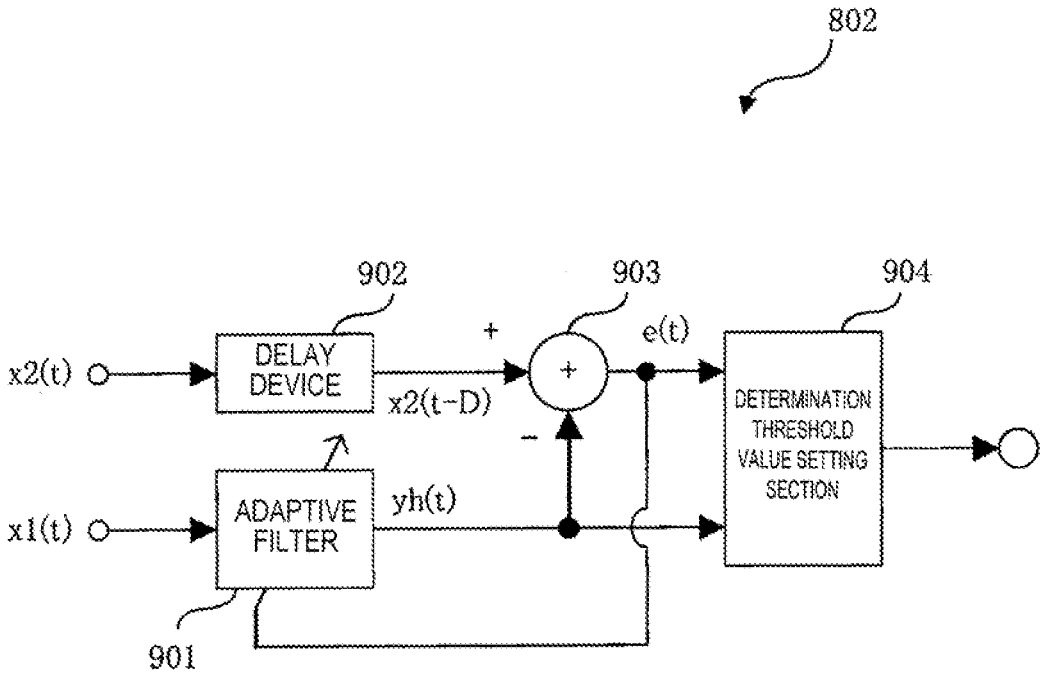
FIG. 18 is a block diagram showing an internal configuration of the distance determination threshold value setting section of the sound processing apparatus according to the third embodiment.

The distance determination threshold value setting section 802 calculates the reverberation level contained in the sound signal x2(t). The distance determination threshold value setting section 802 sets the first threshold value β1 and the second threshold value β2 according to the calculated reverberation level. FIG. 18 shows an example of an internal configuration of the distance determination threshold value setting section 802 equipped with an adaptive filter.

FIG. 18 is a block diagram showing the internal configuration of the distance determination threshold value setting section 802. The distance determination threshold value setting section 802 is formed of an adaptive filter 901, a delay device 902, a difference signal calculation section 903, and a determination threshold value setting section 904.

The adaptive filter 901 convolutes the coefficient of the adaptive filter 901 with the sound signal x1(t) output from the first directivity forming section 1103. Next, the adaptive filter 901 outputs the convoluted sound signal yh(t) to each of the difference signal calculation section 903 and the determination threshold value setting section 904.

The delay device 902 delays the sound signal x2(t) output from the second directivity forming section 1104 by a predetermined amount and outputs the delayed sound signal x2(t−D) to the difference signal calculation section 903. The parameter D represents the number of samples delayed by the delay device 902.

The difference signal calculation section 903 obtains the sound signal yh(t) output from the adaptive filter 901 and the sound signal x2(t−D) delayed by the delay device 902. The difference signal calculation section 903 calculates the difference signal e(t) between the sound signal x2(t−D) and the sound signal yh(t).

The difference signal calculation section 903 outputs the calculated difference signal e(t) to the determination threshold value setting section 904. The adaptive filter 901 renews the coefficient of the filter by using the difference signal e(t) calculated by the difference signal calculation section 903. The coefficient of the filter is adjusted so that the direct sound component contained in the sound signal x2(t) output from the second directivity forming section 1104 is eliminated.

Furthermore, as algorithms for renewing the coefficient of the adaptive filter 901, the learning identification method, affine projection method, recursive least square method, etc. are used. Furthermore, the tap length of the filter 901 is made relatively short since only the direct sound component of the sound signal x2(t) output from the second directivity forming section 1104 is eliminated and the reverberant sound component of the sound signal x2(t) is output as the difference signal. For example, the tap length of the filter 901 is a length corresponding to approximately several [msec] to several ten [msec].

The delay device 902 for delaying the sound signal x2(t) output from the second directivity forming section 1104 is inserted to satisfy the causality with the first directivity forming section 1103. This is because a predetermined amount of delay occurs inevitably when the sound signal x1(t) output from the first directivity forming section 1103 passes through the adaptive filter 901.

The number of samples to be delayed is set to a value approximately half of the tap length of the adaptive filter 901.

The determination threshold value setting section 904 obtains each of the difference signal e(t) output from the difference signal calculation section 903 and the sound signal yh(t) output from the adaptive filter 901. The determination threshold value setting section 904 calculates the level Le(t) by using the obtained difference signal e(t) and the obtained sound signal yh(t) and sets the first threshold value β1 and the second threshold value β2.

The level Le(t) [dB] is calculated according to Mathematical expression (6). The parameter L is the number of samples for level calculation. The number of samples L represents a value indicating the length of one phrase or one word; for example, in the case that the length is 2 [sec] and that the sampling frequency is 8 [kHz], L=16000. In Mathematical expression (6), in order that the dependence to the absolute level of the difference signal e(t) is reduced, normalization is performed at the level of the sound signal yh(t) that serves as the estimated signal of the direct sound and is output from the adaptive filter 901.

[Mathematical expression 6]

$$Le(t) = 10\log_{10}\left(\frac{\sum_{n=0}^{L-1} e^2(t-n)}{\sum_{n=0}^{L-1} yh^2(t-n)}\right) \tag{6}$$

In Mathematical expression (6), the value of the level Le(t) becomes large in the case that the reverberant sound component is abundant, and the value becomes small in the case that the reverberant sound component is scarce. For example, as an extreme example, in an anechoic room with no reverberation, the numerator in Mathematical expression (6) becomes small, whereby Le(t) becomes a value close to −∞ [dB]. On the other hand, in a reverberation room with high reverberation and close to a diffused sound field, the denominator and the numerator in Mathematical expression (6) have the same level, whereby Le(t) becomes a value close to 0 [dB].

Hence, in the case that the level Le(t) is larger than a predetermined value, reverberant sound is picked up abundantly by the second directivity forming section 1104 even in the case that the utterer is close to the user. The predetermined value is −10 [dB] for example.

In this case, since the level difference ΔLx(t) between the level Lx1(t) and the level Lx2(t) calculated by the first and second directivity forming sections 1103 and 1104 respectively becomes small, the first threshold value β1 and the second threshold value β2 are respectively set to small values.

Conversely, in the case that the level Le(t) is smaller than a predetermined value, reverberant sound is not picked up abundantly by the second directivity forming section 1104. The predetermined value is −10 [dB] for example. In this case, since the level difference ΔLx(t) between the level Lx1(t) and the level Lx2(t) calculated by the first and second directivity forming sections 1103 and 1104 respectively becomes large, the first threshold value β1 and the second threshold value β2 are respectively set to large values.

To the utterer distance determination section 105, the voice activity detection result information from the voice activity detection section 501, the self-utterance sound determination result information from the self-utterance sound determination section 801, and the first and second threshold values β1 and β2 having been set by the distance determination threshold value setting section 802 are input. Next, the utterer distance determination section 105 determines whether the utterer is close to the user on the basis of the voice activity detection result information having been input, the self-utterance sound determination result information having been input and the first and second threshold values β1 and β2 having been set. The utterer distance determination section 105 outputs the distance determination result information obtained by the determination to the gain derivation section 106.

(The Operation of the Sound Processing Apparatus 13 According to the Fourth Embodiment)

Figure 19:
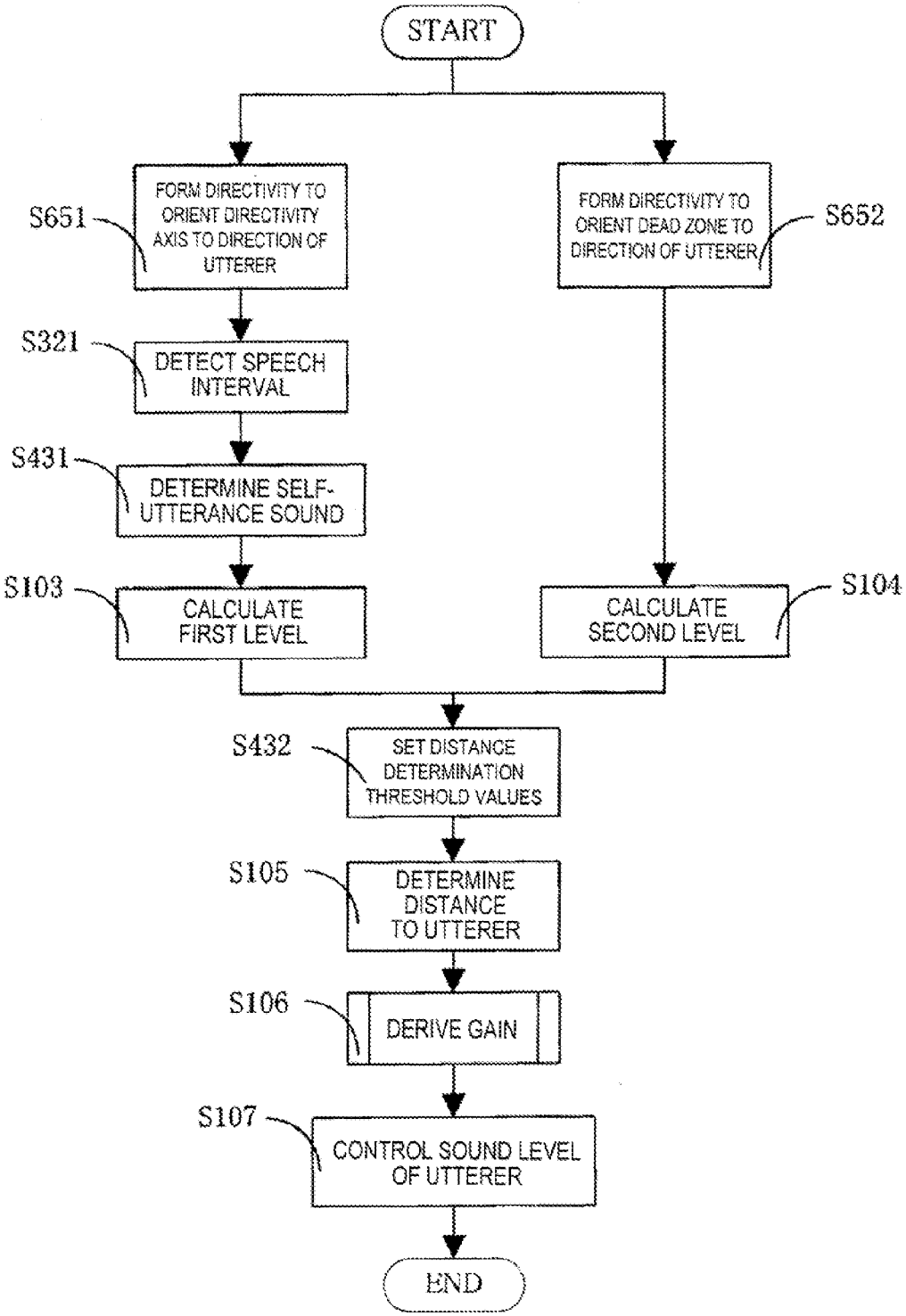
FIG. 19 is a flowchart illustrating the operation of the sound processing apparatus according to the third embodiment.

Next, the operation of the sound processing apparatus 13 according to the fourth embodiment will be described referring to FIG. 19. FIG. 19 is a flowchart illustrating the operation of the sound processing apparatus 13 according to the fourth embodiment. In FIG. 19, the description of the same operation as the operation of the sound processing apparatus 13 according to the third embodiment shown in FIG. 16 is omitted, and the processes relating to the above-mentioned components will mainly be described.

The voice activity detection section 501 outputs the detected voice activity detection result information to each of the utterer distance determination section 105 and the self-utterance sound determination section 801. The self-utterance sound determination section 801 obtains the voice activity detection result information output from the voice activity detection section 501.

The self-utterance sound determination section 801 determines whether the sound detected by the voice activity detection section 501 is self-utterance sound by using the absolute sound pressure level of the level Lx3($t$) in the voice activity based on the obtained voice activity detection result information (at S431). The self-utterance sound determination section 801 outputs the self-utterance sound determination result information corresponding to the result of the determination to each of the distance determination threshold value setting section 802 and the utterer distance determination section 105.

The distance determination threshold value setting section 802 obtains the self-utterance sound determination result information output from the self-utterance sound determination section 801. The distance determination threshold value setting section 802 calculates the reverberation level contained in the sound signal x2($t$) by using the sound signals x1($t$) and x2($t$) in the speech interval having determined as self-utterance sound by the self-utterance sound determination section 801. The distance determination threshold value setting section 802 sets the first threshold value β1 and the second threshold value β2 according to the calculated reverberation level (at S432).

To the utterer distance determination section 105, the voice activity detection result information from the voice activity detection section 501, the self-utterance sound determination result information from the self-utterance sound determination section 801, and the first and second threshold values β1 and β2 having been set by the distance determination threshold value setting section 802 are input. Next, the utterer distance determination section 105 determines whether the utterer is close to the user on the basis of the voice activity detection result information having been input, the self-utterance sound determination result information having been input and the first and second threshold values β1 and β2 having been set (at S105).

The utterer distance determination section 105 outputs the distance determination result information obtained by the determination to the gain derivation section 106. The details of the following processes are the same as those in the first embodiment (refer to FIG. 5) and the descriptions thereof are omitted.

As described above, in the sound processing apparatus according to the fourth embodiment, a determination as to whether self-utterance sound is contained in the sound signal x1($t$) picked up by the first directivity forming section is made by the self-utterance sound determination section added to the internal configuration of the sound processing apparatus according to the third embodiment.

Furthermore, the reverberation levels contained in the sound signals respectively picked up by the second directivity forming section are calculated in the speech interval having been determined as self-utterance sound by the distance determination threshold value setting section added to the internal configuration of the sound processing apparatus according to the third embodiment. Moreover, the first threshold value β1 and the second threshold value β2 are set according to the calculated reverberation levels by the distance determination threshold value setting section.

In this embodiment, on the basis of the first threshold value β1 and the second threshold value β2 having been set and the voice activity detection result information and the self-utterance sound determination result information, it is determined whether the utterer is close to or far away from the user. The gain calculated according to the result of the determination is multiplied to the sound signal output to the first directivity forming section 1103 for picking up the direct sound of the utterer, and the level is controlled.

Hence, in this embodiment, the sound of the utterer close to the user, such as the conversational partner thereof, is emphasized; conversely, the sound of the utterer far away from the user is attenuated or suppressed. As a result, only the sound of the conversational partner close to the user is emphasized so as to be heard clearly and efficiently, regardless of the distance between the microphones.

Furthermore, in this embodiment, since the distance of the utterer is determined only in the speech interval of the sound signal x1($t$) output from the first directivity forming section 1103, the distance of the utterer can be determined highly accurately.

In addition, in this embodiment, since the reverberation level of the sound signal is calculated by using the self-utterance sound in the detected speech interval, the threshold values for determining the distance can be set dynamically according to the reverberation levels. Hence, in this embodiment, the distance between the user and the utterer can be determined highly accurately.

Fifth Embodiment

Figure 20:
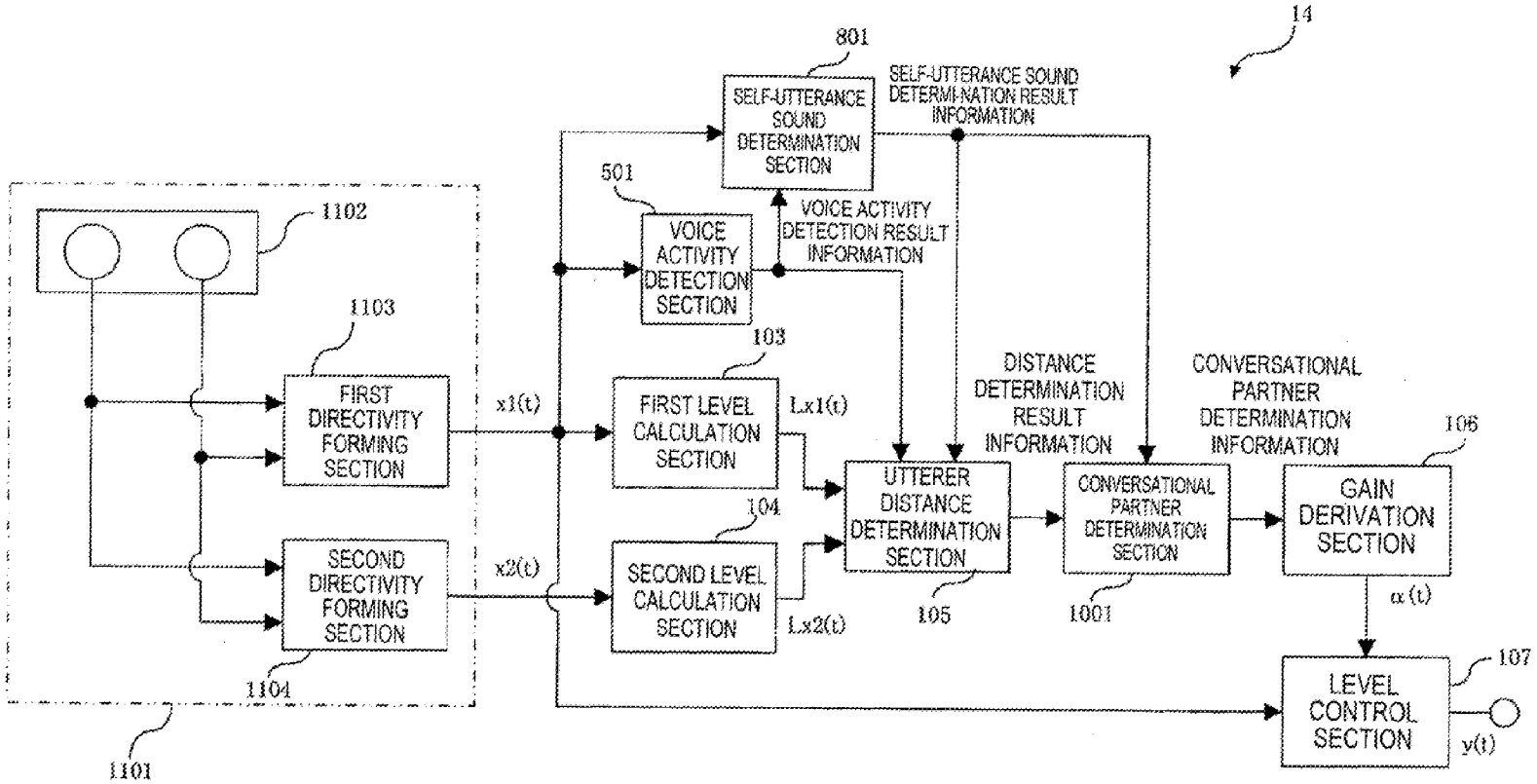
FIG. 20 is a block diagram showing an internal configuration of a sound processing apparatus according to a fourth embodiment.

FIG. 20 is a block diagram showing an internal configuration of a sound processing apparatus 14 according to a fifth embodiment. The sound processing apparatus 14 according to the fifth embodiment is different from the sound processing apparatus 12 according to the third embodiment in that the apparatus further has components, that is, the self-utterance sound determination section 801 and a conversational partner determination section 1001 as shown in FIG. 20. In FIG. 20, the same components as those shown in FIG. 7 are designated by the same reference codes and the descriptions thereof are omitted.

(The Internal Configuration of the Sound Processing Apparatus 14 According to the Fifth Embodiment)

The self-utterance sound determination section 801 obtains the voice activity detection result information output from the voice activity detection section 501. The self-utterance sound determination section 801 determines whether the sound detected by the voice activity detection section 501 is self-utterance sound by using the absolute sound pressure level of the level Lx3($t$) in the speech interval based on the obtained voice activity detection result information.

Since the mouth of the user serving as the sound source of the self-utterance sound is close to the user's ear in which the first directivity forming section 1103 is disposed; hence, the absolute sound pressure level of the self-utterance sound picked up by the first directivity forming section 1103 is high. In the case that the level Lx3(*t*) is equal to or more than the fourth threshold value β4, the sound corresponding to the level Lx3(*t*) is determined as self-utterance sound.

The fourth threshold value β4 is 74 [dB(SPL)] for example. The self-utterance sound determination section 801 outputs the self-utterance sound determination result information corresponding to the result of the determination to the conversational partner determination section 1001. Furthermore, the self-utterance sound determination section 801 may output the self-utterance sound determination result information to each of the utterer distance determination section 105 and the conversational partner determination section 1001.

The utterer distance determination section 105 determines whether the utterer is close to the user on the basis of the voice activity detection result information from the voice activity detection section 501. Furthermore, the utterer distance determination section 105 may obtain the self-utterance sound determination result information output from the self-utterance sound determination section 801.

In this case, the utterer distance determination section 105 determines the distance to the utterer in the interval detected as the speech interval excluding the speech interval having been determined as self-utterance sound. The utterer distance determination section 105 outputs the determined distance determination result information to the conversational partner determination section 1001 on the basis of the voice activity detection result information.

Moreover, the utterer distance determination section 105 may output the distance determination result information obtained by the determination to the conversational partner determination section 1001 on the basis of the voice activity detection result information and the self-utterance sound determination result information.

The conversational partner determination section 1001 obtains the self-utterance sound determination result information from the self-utterance sound determination section 801 and the distance determination result information from the utterer distance determination section 105.

In the case that it is determined that the utterer is close to the user, the conversational partner determination section 1001 determines whether the utterer is the conversational partner of the user by using the sound of the utterer close to the user and the self-utterance sound determined by the self-utterance sound determination section 801.

The case in which the utterer distance determination section 105 determines that the utterer is close to the user is the case in which the distance determination result information indicates "1".

In the case that it is determined that the utterer is the conversational partner of the user, the conversational partner determination section 1001 outputs the conversational partner determination information "1" to the gain derivation section 106. On the other hand, in the case that it is determined that the utterer is not the conversational partner of the user, the conversational partner determination section 1001 outputs the conversational partner determination information "0" or "−1" to the gain derivation section 106.

An example in which the conversational partner determination section 1001 determines whether the utterer is the conversational partner of the user on the basis of the self-utterance sound determination result information and the distance determination result information will be described referring to FIG. 21 and FIG. 22.

Figure 21:
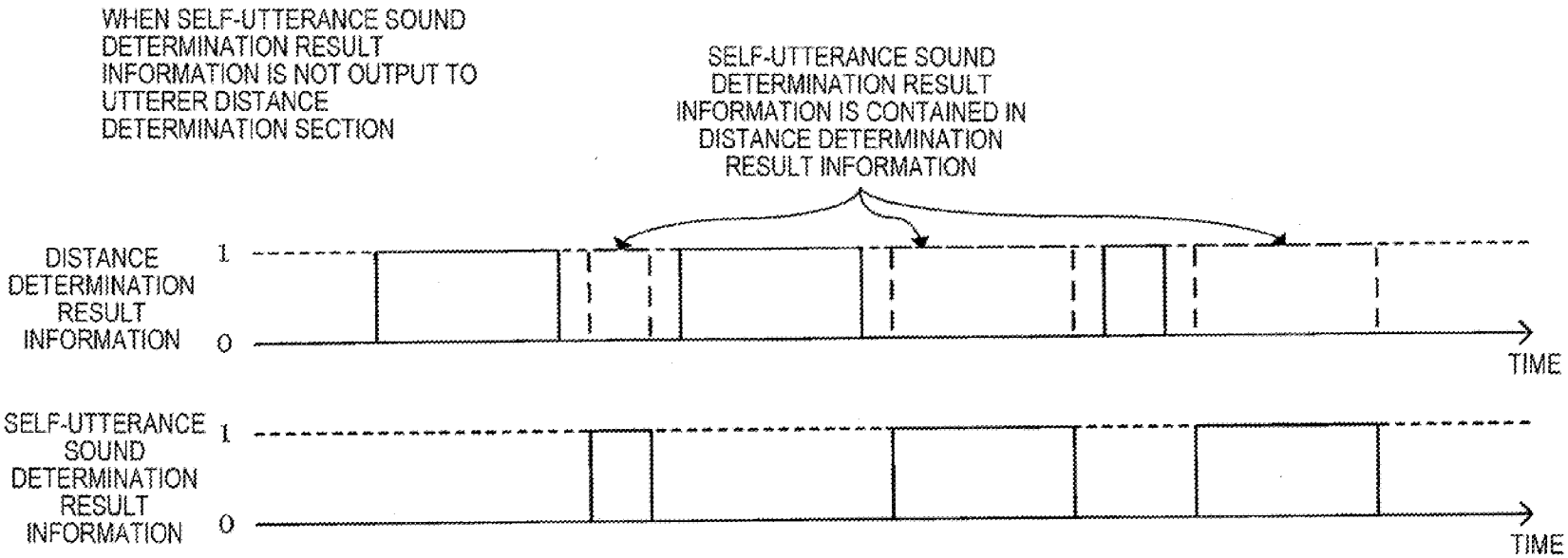
FIG. 21 is a view showing an example in which distance determination result information and self-utterance sound determination result information are represented in the same time axis.

FIG. 21 is a view showing an example in which the distance determination result information and the self-utterance sound determination result information are represented in the same time axis. FIG. 22 is a view showing another example in which the distance determination result information and the self-utterance sound determination result information are represented in the same time axis. The distance determination result information and the self-utterance sound determination result information shown in FIGS. 21 and 22 are referred to by the conversational partner determination section 1001.

FIG. 21 is a view at the time when the self-utterance sound determination result information is not output to the utterer distance determination section 105; in this case, the self-utterance sound determination result information is output to the conversational partner determination section 1001. When the self-utterance sound determination result information is "1", the distance determination result information also becomes "1" as shown in FIG. 21. At this time, the conversational partner determination section 1001 treats the distance determination result information as "0". In the case that the state in which the distance determination result information is "1" and the state in which the self-utterance sound determination result information is "1" occur alternately and almost continuously in terms of time, the conversational partner determination section 1001 determines that the utterer is the conversational partner of the user.

Figure 22:
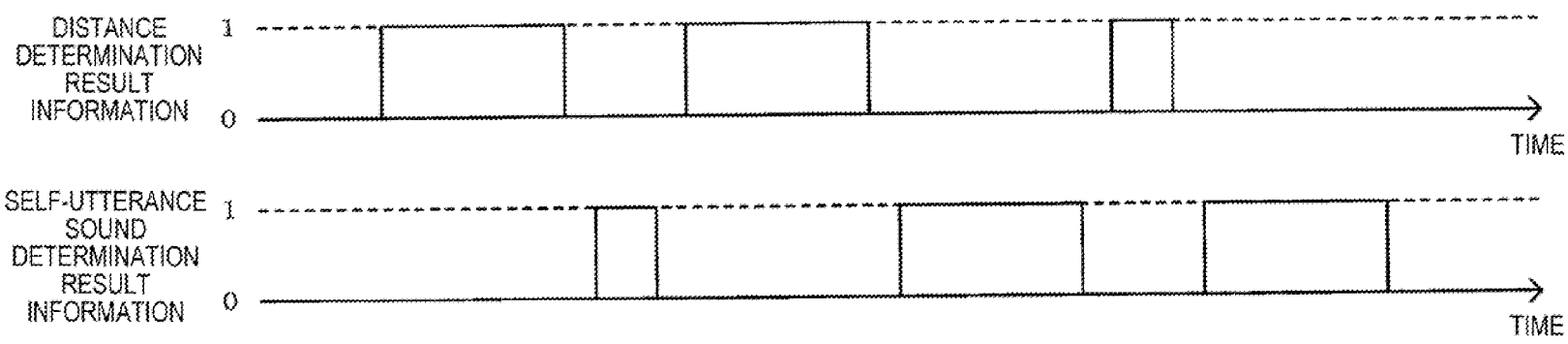
FIG. 22 is a view showing another example in which the distance determination result information and the self-utterance sound determination result information are represented in the same time axis.

In addition, FIG. 22 is a view at the time when the self-utterance sound determination result information is output to the utterer distance determination section 105. As shown in FIG. 22, in the case that the state in which the distance determination result information is "1" and the state in which the self-utterance sound determination result information is "1" occur alternately and almost continuously in terms of time as shown in FIG. 22, the conversational partner determination section 1001 determines that the utterer is the conversational partner of the user.

The gain derivation section 106 derives the gain α(t) by using the conversational partner determination result information from the conversational partner determination section 1001. More specifically, in the case that the conversational partner determination result information is "1", since the utterer is determined as the conversational partner of the user, the gain derivation section 106 sets the installation gain α'(t) to "2.0".

Moreover, in the case that the conversational partner determination result information is "0" or "−1", since the utterer is not determined as the conversational partner of the user, the gain derivation section sets the installation gain α'(t) to "0.5" or "1.0". The gain may be set to "0.5" or "1.0".

The gain derivation section 106 derives the gain α(t) according to Mathematical expression (4) described above by using the derived installation gain α'(t) and outputs the derived gain α(t) to the level control section 107.

(The Operation of the Sound Processing Apparatus 14 According to the Fifth Embodiment)

Figure 23:
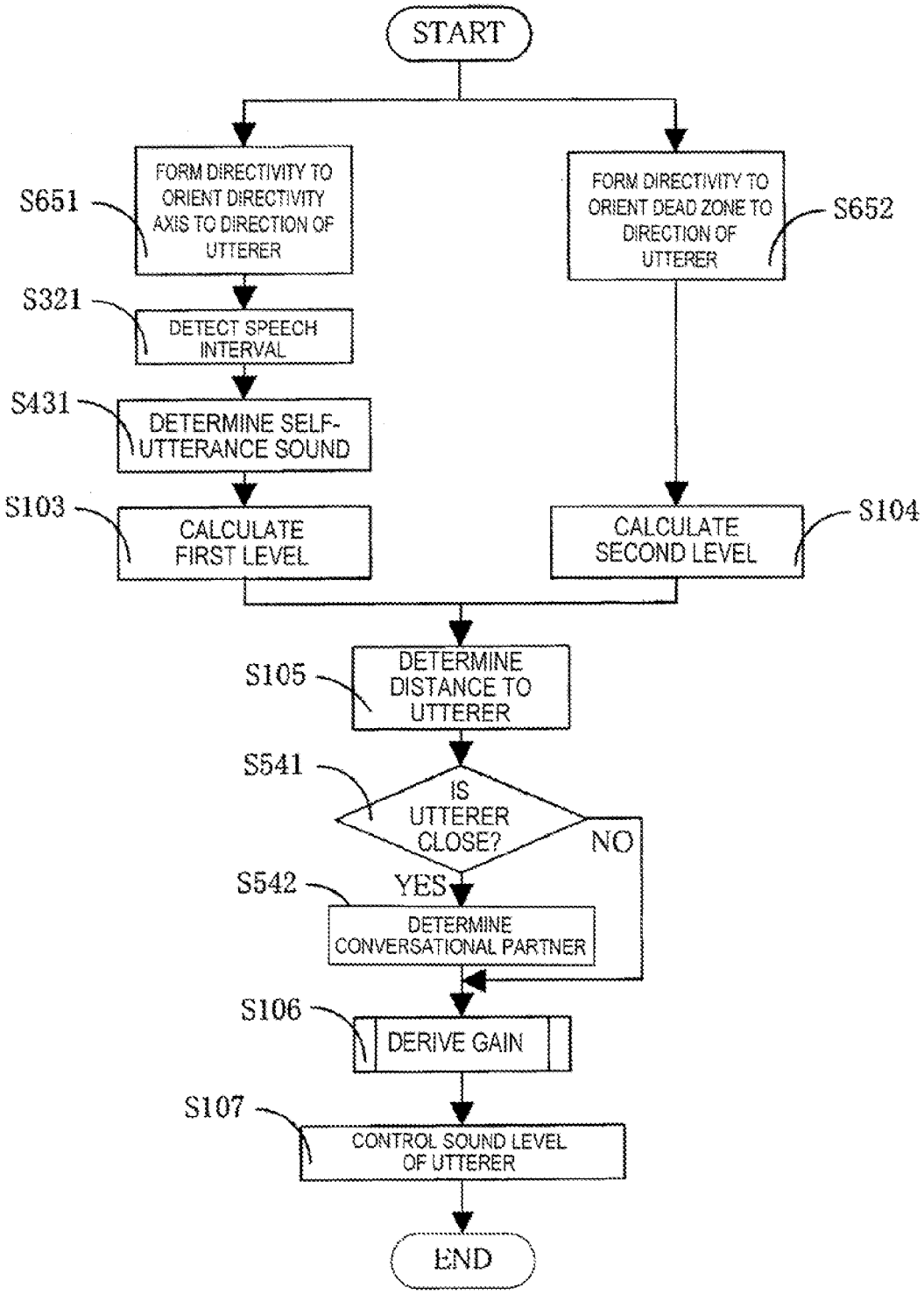
FIG. 23 is a flowchart illustrating the operation of the sound processing apparatus according to the fourth embodiment.

Next, the operation of the sound processing apparatus 14 according to the fifth embodiment will be described referring to FIG. 23. FIG. 23 is a flowchart illustrating the operation of the sound processing apparatus 14 according to the fifth embodiment. In FIG. 23, the description of the same operation as the operation of the sound processing apparatus 12 according to the third embodiment shown in FIG. 16 is omitted, and the processes relating to the above-mentioned components will mainly be described.

The voice activity detection section 501 outputs the detected voice activity detection result information to each of the utterer distance determination section 105 and the self-utterance sound determination section 801. The self-utterance sound determination section 801 obtains the voice activity detection result information output from the voice activity detection section 501.

The self-utterance sound determination section 801 determines whether the sound detected by the voice activity detection section 501 is self-utterance sound by using the absolute sound pressure level of the level Lx3(*t*) in the speech interval based on the voice activity detection result information (at S431).

The self-utterance sound determination section 801 outputs the self-utterance sound determination result information corresponding to the result of the determination to the conversational partner determination section 1001. In addition, it may be possible that the self-utterance sound determination section 801 outputs the self-utterance sound determination result information to the conversational partner determination section 1001 and the utterer distance determination section 105.

The utterer distance determination section 105 determines whether the utterer is close to the user on the basis of the voice activity detection result information from the voice activity detection section 501 (at S105). In the case that it is determined that the utterer is close to the user by the utterer distance determination section 105 (YES at S541), the conversational partner determination section 1001 determines whether the utterer is the conversational partner of the user (at S542). More specifically, the conversational partner determination section 1001 determines whether the utterer is the conversational partner of the user by using the sound of the utterer close to the user and the self-utterance sound having been determined by the self-utterance sound determination section 801.

In the case that it is determined that the utterer is not close to the user by the utterer distance determination section 105, that is, in the case that the distance determination result information is "0" (NO at S541), the gain deriving process using the gain derivation section 106 is performed (at S106).

The gain derivation section 106 derives the gain $\alpha(t)$ by using the conversational partner determination result information from the conversational partner determination section 1001 (at S106). The details of the following processes are the same as those in the first embodiment (refer to FIG. 5) and the descriptions thereof are omitted.

As described above, in the sound processing apparatus according to the fifth embodiment, a determination as to whether self-utterance sound is contained in the sound signal x1(*t*) picked up by the first directivity forming section is made by the self-utterance sound determination section added to the internal configuration of the sound processing apparatus according to the third embodiment.

Furthermore, in this embodiment, in the speech interval in which it has been determined that the utterer is close to the user by the conversational partner determination section, it is determined whether the utterer is the conversational partner of the user on the basis of the time-wise chronological order of the self-utterance sound determination result information and the distance determination result information.

The gain calculated on the basis of the conversational partner determination result information obtained by the determination is multiplied to the sound signal output to the first directivity forming section for picking up the direct sound of the utterer, and the level is controlled.

Hence, in this embodiment, the sound of the utterer close to the user, such as the conversational partner thereof, is emphasized; conversely, the sound of the utterer far away from the user is attenuated or suppressed. As a result, only the sound of the conversational partner close to the user is emphasized so as to be heard clearly and efficiently, regardless of the distance between the microphones.

Furthermore, in this embodiment, since the distance of the utterer is determined only in the speech interval of the sound signal x1(*t*) output from the first directivity forming section, the distance of the utterer can be determined highly accurately.

Furthermore, in this embodiment, the sound of the utterer can be emphasized only in the case that the utterer close to the user is the conversational partner, and the sound of only the conversational partner of the user can be heard clearly.

Sixth Embodiment

Figure 24:
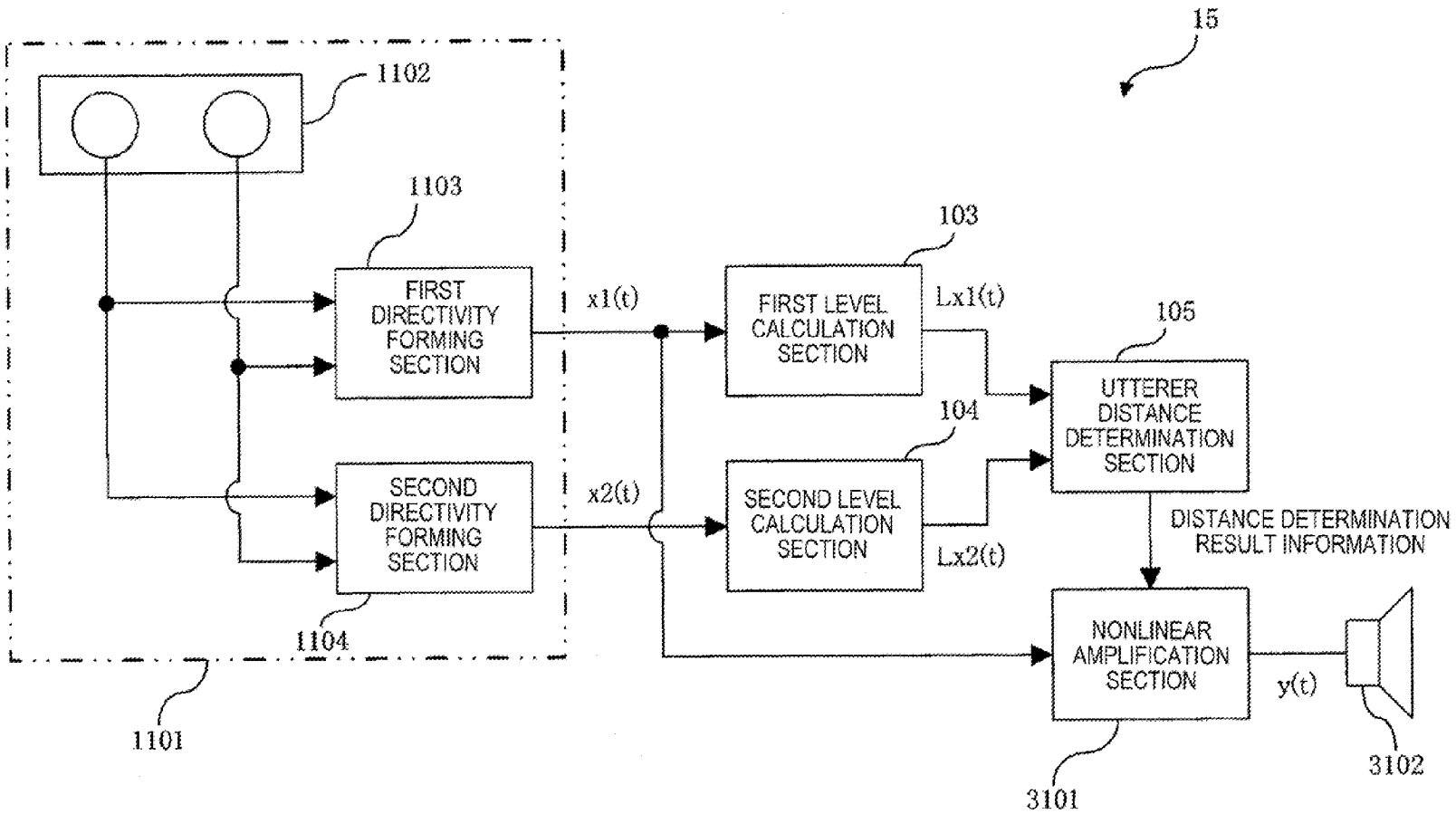
FIG. 24 is a block diagram showing an internal configuration of a sound processing apparatus according to a fifth embodiment.

FIG. 24 is a block diagram showing an internal configuration of a sound processing apparatus 15 according to a sixth embodiment. The sound processing apparatus 15 according to the sixth embodiment is an apparatus in which the sound processing apparatus 11 according to the second embodiment is applied to a hearing aid. The apparatus is different from the sound processing apparatus 11 according to the second embodiment in that the gain derivation section 106 and the level control section 107 shown in FIG. 7 are integrated into a nonlinear amplification section 3101 and that the apparatus is further equipped with a speaker 3102 as a sound output section as shown in FIG. 24. In the sixth embodiment, the same components as those shown in FIG. 7 are designated by the same reference codes and the descriptions of the components are omitted.

(The Internal Configuration of the Sound Processing Apparatus 15 According to the Sixth Embodiment)

The nonlinear amplification section 3101 obtains the sound signal x1(*t*) output from the first directivity forming section 1103 and the distance determination result information output from the utterer distance determination section 105. On the basis of the distance determination result information output from the utterer distance determination section 105, the nonlinear amplification section 3101 amplifies the sound signal x1(*t*) output from the first directivity forming section 1103 and outputs the signal to the speaker 3102.

Figure 25:
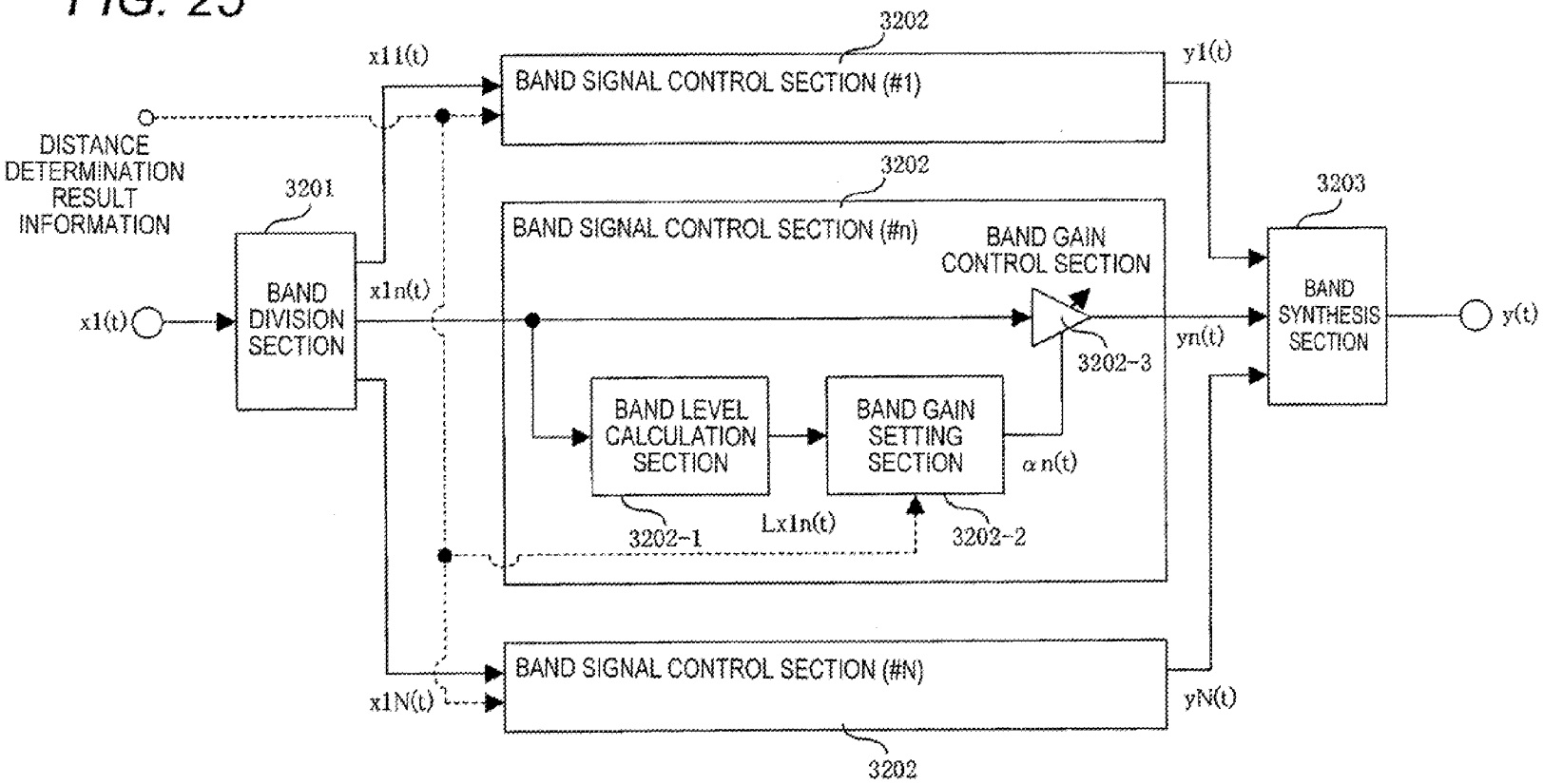
FIG. 25 is a block diagram showing an internal configuration of the nonlinear amplification section of the sound processing apparatus according to the fifth embodiment.

FIG. 25 is a block diagram showing an example of an internal configuration of the nonlinear amplification section 3101. As shown in FIG. 25, the nonlinear amplification section 3101 has a band division section 3201, a plurality of band signal control sections (#1 to "N) 3202, and a band synthesis section 3203.

The band division section 3201 divides the sound signal x1(*t*) from the first directivity forming section 1103 into N band frequency band signals x1*n*(t) using a filter or the like. The parameter n is n=1 to N. A DFT (Discrete Fourier Transform) filter bank, a band pass filter, etc. is used as the filter.

On the basis of the distance determination result information from the utterer distance determination section 105 and the level of each frequency band signal x1*n*(t) from the band division section 3201, each of the band signal control sections (#1 to "N) 3202 sets a gain that is multiplied to each frequency band signal x1*n*(t). Next, each of the band signal control sections (#1 to #N) 3202 controls the level of each frequency band signal x1*n*(t) by using the set gain.

FIG. 25 shows an internal configuration of the band signal control section (#n) 3202 in the frequency band #n among the band signal control sections (#1 to #N) 3202. The band signal control section (#n) 3202 has a band level calculation section 3202-1, a band gain setting section 3202-2, and a band gain control section 3202-3. The band signal control sections 3202 in the other frequency bands have similar internal configurations.

The band level calculation section 3202-1 calculates the level Lx1*n*(t) [dB] of the frequency band signal x1*n*(t). The calculation is performed using a level calculation method, such as Mathematical expression (1) described above.

To the band gain setting section 3202-2, the band level Lx1*n*(t) calculated by the band level calculation section 3202-1 and the distance determination result information output from the utterer distance determination section 105 are input. Next, on the basis of the band level Lx1*n*(t) and the distance determination result information, the band gain setting section 3202-2 sets a band gain an(t) that is multiplied to the band signal x1*n*(t) serving as the control target of the band signal control section 3202.

Figure 26:
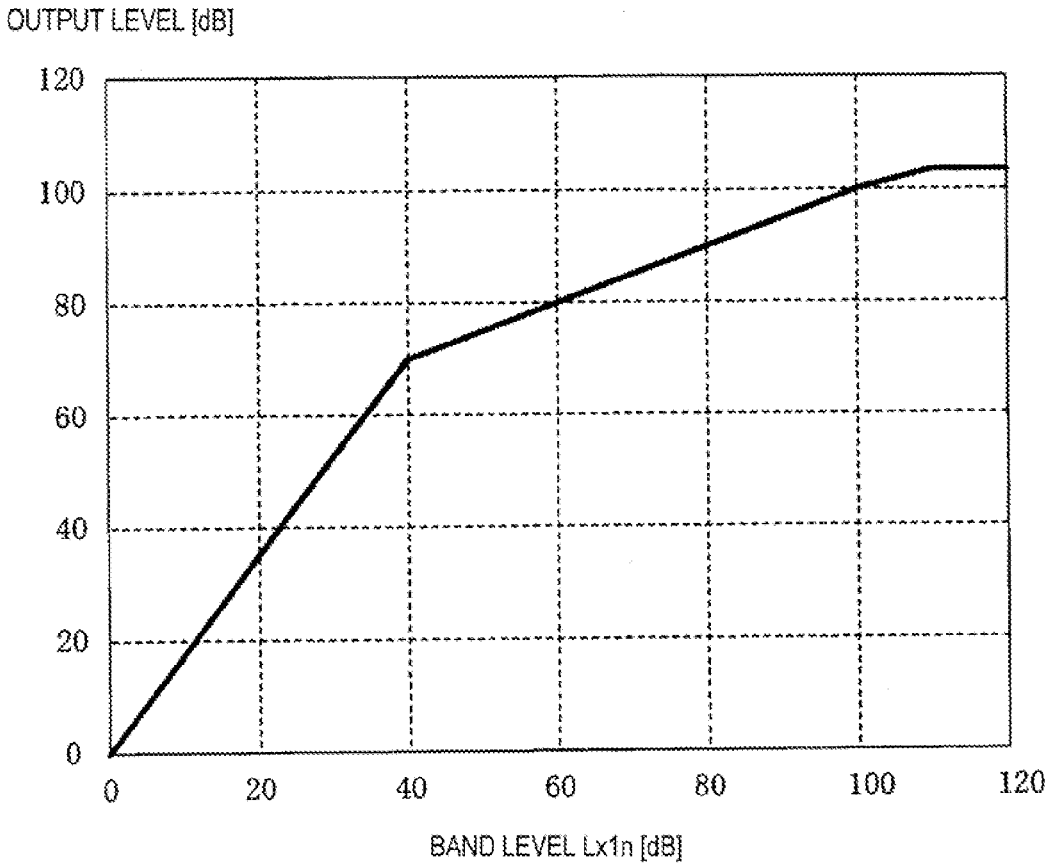
FIG. 26 is a view illustrating the input-output characteristics of the level for compensating for the aural characteristics of the user.

More specifically, in the case that the distance determination result information is "1", the utterer is close to the user and it is highly likely that the utterer is the conversational partner of the user. Hence, the band gain setting section 3202-2 sets the band gain an(t) for compensating for such aural characteristics of the user as shown in FIG. 26 by using the band level Lx1*n*(t) of the signal. FIG. 26 is a view illustrating the input-output characteristics of the level for compensating for the aural characteristics of the user.

In the case of the band level Lx1*n*(t)=60 [dB] for example, for the purpose of setting the output band level to 80 [dB], the band gain setting section 3202-2 sets a gain vale an(t)=10 [times] (=10^(20/20)) that is used to raise the band gain by 20 [dB].

Furthermore, in the case that the distance determination result information is "0" or "−1", the utterer is not close to the user and it is less likely that the utterer is the conversational partner of the user. Hence, the band gain setting section 3202-2 sets "1.0" as the band gain an(t) for the band signal x1*n*(t) serving as the control target.

The band gain control section 3202-3 multiplies the band gain an(t) to the band signal x1*n*(t) serving as the control target, thereby calculating a band signal yn(t) after the control by the band signal control section 3202.

The band synthesis section 3203 synthesizes the respective band signals yn(t) by using a method corresponding to the band division section 3201, thereby calculating a signal y(t) after the band synthesis.

The speaker 3102 outputs the signal y(t) after the band synthesis in which the band gain has been set by the nonlinear amplification section 3101.

(The Operation of the Sound Processing Apparatus 15 According to the Sixth Embodiment)

Figure 27:
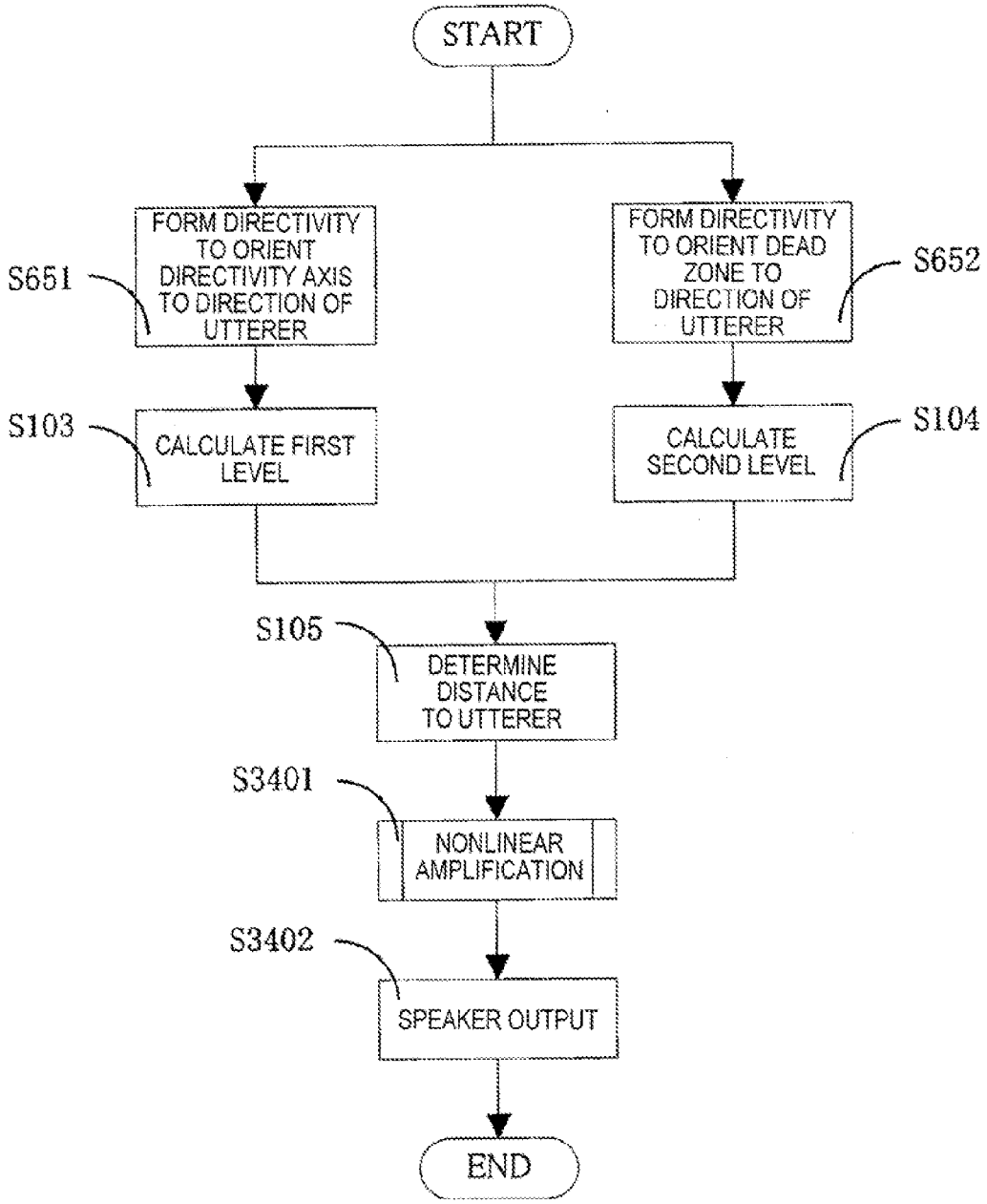
FIG. 27 is a flowchart illustrating the operation of the sound processing apparatus according to the fifth embodiment.

Next, the operation of the sound processing apparatus 15 according to the sixth embodiment will be described referring to FIG. 27. FIG. 27 is a flowchart illustrating the operation of the sound processing apparatus 15 according to the sixth embodiment. In FIG. 27, the description of the same operation as the operation of the sound processing apparatus 11 according to the second embodiment shown in FIG. 12 is omitted, and the processes relating to the above-mentioned components will mainly be described.

The nonlinear amplification section 3101 obtains the sound signal x1(*t*) output from the first directivity forming section 1103 and the distance determination result information output from the utterer distance determination section 105. Next, on the basis of the distance determination result information output from the utterer distance determination section 105, the nonlinear amplification section 3101 amplifies the sound signal x1(*t*) output from the first directivity forming section 1103 and outputs the signal to the speaker 3102 (at S3401).

Figure 28:
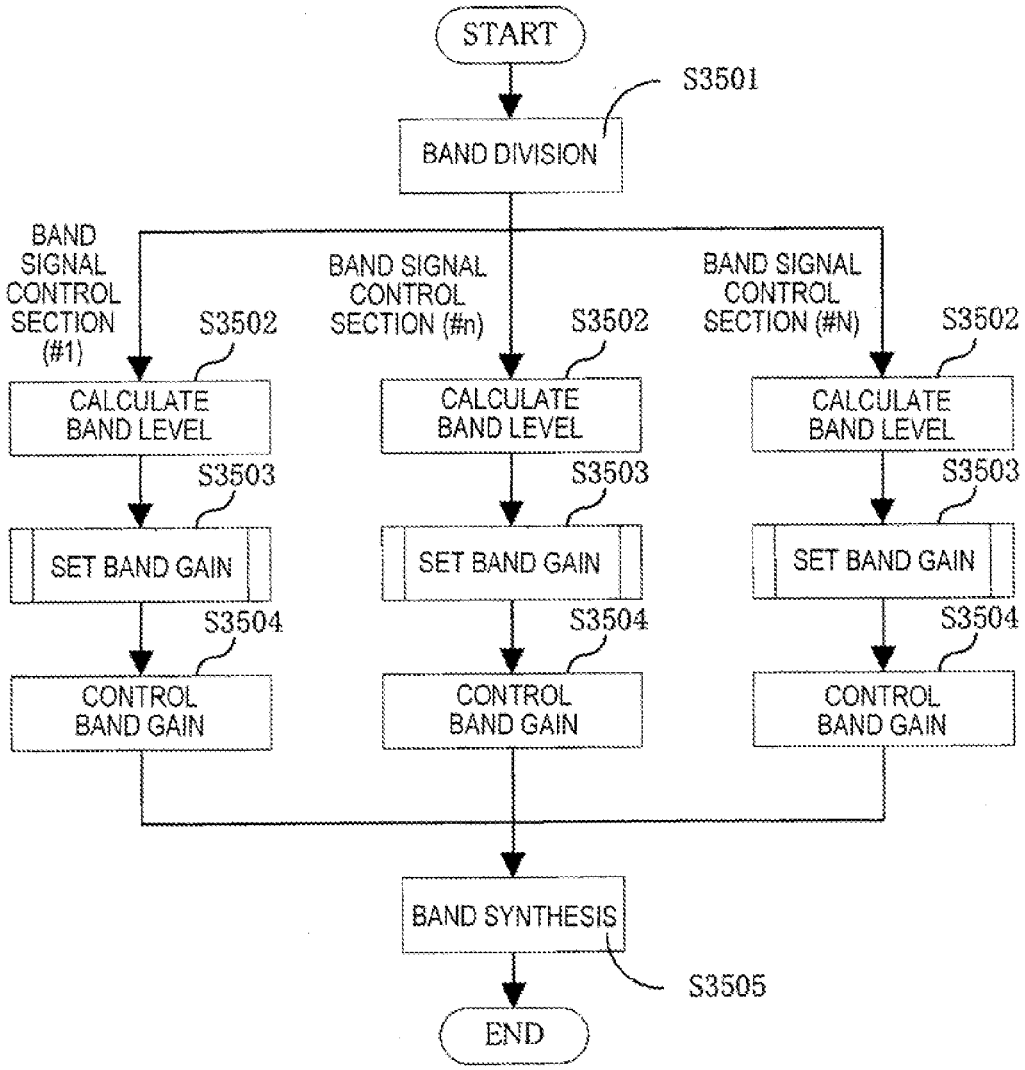
FIG. 28 is a flowchart illustrating the operation of the nonlinear amplification section of the sound processing apparatus according to the fifth embodiment.

The details of the processes of the nonlinear amplification section 3101 will be described referred to FIG. 28. FIG. 28 is a flowchart illustrating the details of the operation of the nonlinear amplification section 3101.

The band division section 3201 divides the sound signal x1(*t*) output from the first directivity forming section 1103 into N band frequency band signals x1*n*(t) (at S3501).

The band level calculation section 3202-1 calculates the level Lx1*n*(t) of each respective frequency band signal x1*n*(t) (at S3502).

On the basis of the band level Lx1*n*(t) and the distance determination result information output from the utterer distance determination section 105, the band gain setting section 3202-2 sets the band gain an(t) that is multiplied to the band signal x1*n*(t) (at S3503).

Figure 29:
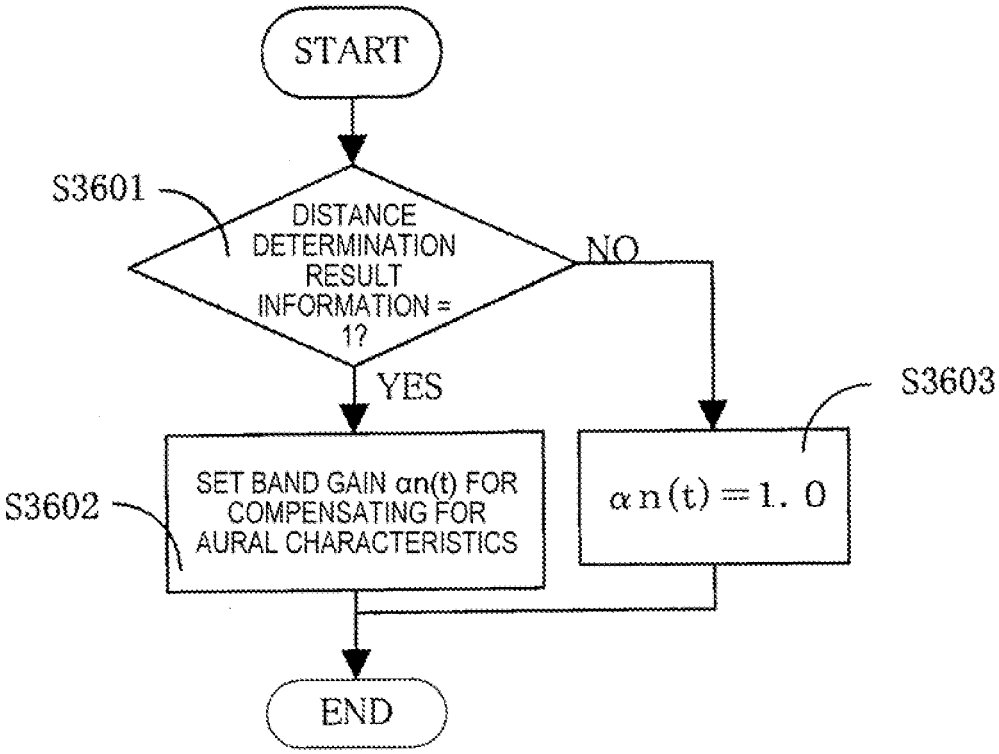
FIG. 29 is a flowchart illustrating the operation of the band gain setting section of the nonlinear amplification section of the sound processing apparatus according to the fifth embodiment.
Figure 30:
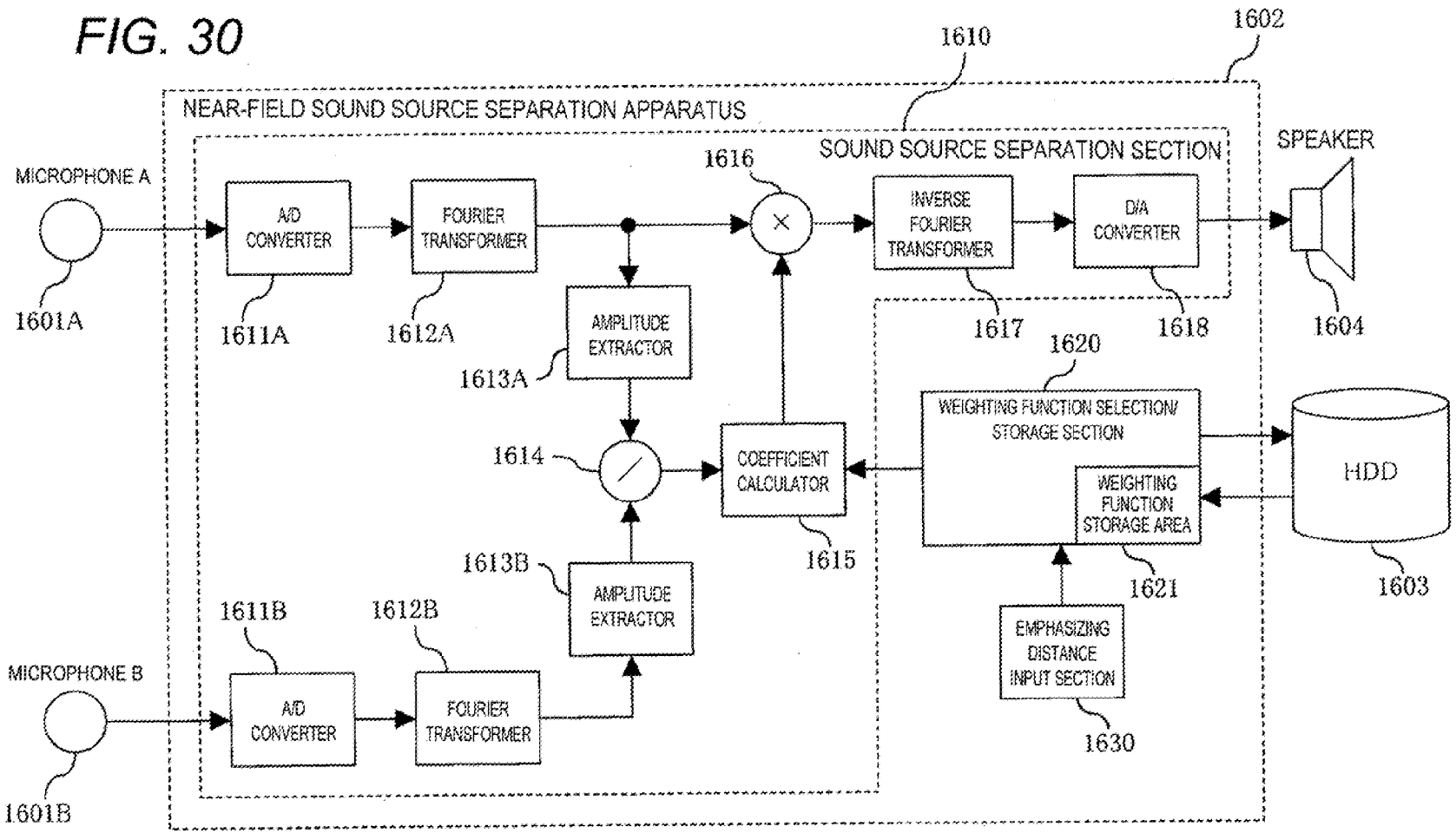
FIG. 30 is a block diagram showing an example of an internal configuration of the conventional sound processing apparatus.

FIG. 29 is a flowchart illustrating the details of the operation of the band gain setting section 3202-2.

In the band gain setting section 3202-2, in the case that the distance determination result information is "1" (YES at S36061), the utterer is close to the user and it is highly likely that the utterer is the conversational partner of the user. Hence, the band gain setting section 3202-2 sets the band gain an(t) for compensating for such aural characteristics of the user as shown in FIG. 26 by using the band level Lx1*n*(t) (at S3602).

Furthermore, in the case that the distance determination result information is "0" or "−1" (NO at S3601), the utterer is not close to the user and it is less likely that the utterer is the conversational partner of the user. Hence, the band gain setting section 3202-2 sets "1.0" as the band gain an(t) for the band signal x1*n*(t) (at S3603).

The band gain control section 3202-3 multiplies the band gain an(t) to the band signal x1*n*(t), thereby calculating the band signal yn(t) after the control by the band signal control section 3202 (at S3504).

The band synthesis section 3203 synthesizes the respective band signals yn(t) by using the method corresponding to the band division section 3201, thereby calculating the signal y(t) after the band synthesis (at S3505).

The speaker 3102 outputs the signal y(t) after the band synthesis in which the gain has been adjusted (at S3402).

As described above, in the sound processing apparatus 15 according to the sixth embodiment, the gain derivation section 106 and the level control section 107 in the internal configuration of the sound processing apparatus 11 according to the second embodiment are integrated into the nonlinear amplification section 3101. Furthermore, the sound processing apparatus 15 according to the sixth embodiment is further equipped with a component, that is, the speaker 3102 in the sound output section; hence, only the sound of the conversational partner can be amplified, and only the sound of the conversational partner of the user can be heard clearly.

Although the various kinds of embodiments have been described above referred to the accompanying drawings, it is needless to say that the sound processing apparatus according to the present invention is not limited to the embodiments. It is obvious that those skilled in the art can think of various kinds of change examples and modification examples within the cope of the claims, and it is understood that those are also assumed to be within the technical scope of the present invention as a matter of course. For example, more accurate utterer level control can be performed by appropriately combining the above-mentioned embodiments 1 to 6.

Although the value of the above-mentioned installation gain α'(t) is specifically described as "2.0" or "0.5", the value is not limited to these values. For example, in the sound processing apparatus according to the present invention, the value of the installation gain $\alpha'(t)$ can also be set individually in advance according to, for example, the degree of hearing difficulty of the user who uses the apparatus as a hearing aid.

In the case that the utterer distance judgment section determines that the utterer is close to the user, the conversational partner determination section according to the fifth embodiment determines whether the utterer is the conversational partner of the user by using the sound of the utterer and the self-utterance sound determined by the self-utterance sound determination section.

In addition, in the case that the utterer distance judgment section 105 determines that the utterer is close to the user, the conversational partner determination section 1001 recognizes the sound of the utterer and the sound of the self-utterance. At this time, in the case that the conversational partner determination section 1001 extracts predetermined keywords in the recognized sound and determines that keywords in the same field are used, it may be possible that the utterer is determined as the conversational partner of the user.

When "travel" is the topic of conversation, the predetermined keywords are, for example, keywords, such as "airplane", "car", "Hokkaido" and "Kyushu", these relating to the same field.

Furthermore, the conversational partner determination section 1001 performs specific utterer recognition for au utterer close to the user. In the case that the person determined as the result of the recognition is a specific utter having been registered in advance or in the case that only one utterer is present around the user, the person is determined as the conversational partner of the user.

Moreover, in the third embodiment shown in FIG. 16, the first level calculation process has been described so as to be performed after the voice activity detection process. However, it may be possible that the first level calculation process is performed before the voice activity detection process.

Besides, in the fourth embodiment shown in FIG. 19, it has been described that the first level calculation process is performed after the voice activity detection process and the self-utterance sound determination process and before the distance determination threshold value setting process.

In the case that the processing order of the voice activity detection process, the self-utterance sound determination process and the distance determination threshold value setting process has been satisfied, it may be possible that the first level calculation process is performed before the sound detection process or the self-utterance sound determination process or after the distance determination threshold value setting.

Similarly, it has been described that the second level calculation process is performed before the distance determination threshold value setting process. However, it may be possible that the second level calculation process is performed after the distance determination threshold value setting.

Still further, in the fifth embodiment shown in FIG. 23, it has been described that the first level calculation process is performed after the voice activity detection process and the self-utterance sound determination process. However, provided that the conditions for allowing the self-utterance sound determination process to be performed after the voice activity detection process have been satisfied, it may be possible that the first level calculation process is performed before the voice activity detection process or the self-utterance sound determination process.

Specifically speaking, the respective processing sections, excluding the above-mentioned microphone array 1102, are each equipped with a computer system formed of a microprocessor, a ROM, a RAM, etc. Each processing section includes the first and second directivity forming sections 1103 and 1104, the first and second level control sections 103 and 104, the utterer distance determination section 105, the gain derivation section 106, the level control section 107, the voice activity detection section 501, the self-utterance sound determination section 801, the distance determination threshold value setting section 802, the conversational partner determination section 1001, etc.

Computer programs are stored in this RAM. The microprocessor operates according to the computer programs, whereby each device accomplishes its function. The computer programs are each formed of a plurality of instruction codes for indicating commands given to the computer to accomplish a predetermined function.

It may be possible that part or whole of the component constituting each processing section described above is formed of one system LSI (Large Scale Integration). The system LSI is a super multifunctional LSI produced by integrating a plurality of components on a single chip, and is, specifically speaking, a computer system formed of a microprocessor, a ROM, a RAM, etc.

Computer programs are stored in the RAM. The microprocessor operates according to the computer programs, whereby the system LSI accomplishes its function.

It may be possible that part or whole of the component constituting each processing section described above is formed of an IC card or a single module that can be attached to or detached from any one of the sound processing apparatuses 10 to 60.

The IC card or module is a computer system formed of a microprocessor, a ROM, a RAM, etc. Furthermore, it may be possible that the IC card or the module includes the above-mentioned super multifunctional LSI. Since the microprocessor operates according to computer programs, the IC card or the module accomplishes its function. It may be possible that the IC card or the module has tamper resistance.

Furthermore, the embodiments according to the present invention may be sound processing methods performed by the above-mentioned sound processing apparatuses. Moreover, the present invention may be computer programs for accomplishing these methods using a computer or may be digital signals constituting computer programs.

Besides, the present invention may be computer programs or digital signals recorded on computer-readable recording media, such as flexible disks, hard disks, CD-ROMs, MOs, DVDs, DVD-ROMs, DVD-RAMs, BDs (Blu-ray Discs) and semiconductor memory devices.

What's more, the present invention may be digital signals recorded on these recording media. Further, the present invention may be computer programs or digital signals to be transmitted via telecommunication lines, wireless or wired communication lines, networks as typified in the Internet, data broadcasting, etc.

Additionally, the present invention may be a computer system equipped with a microprocessor and a memory; the memory may store the above-mentioned computer programs, and the microprocessor may operate according to the computer programs.

Still further, the present invention may execute programs or process digital signals using other independent computer systems by recording the programs or digital signals on recording media and transferring them or by transferring the programs and digital signals via a network or the like.

The present application is based on the Japanese Patent Application (Patent Application No. 2009-242602) filed on Oct. 21, 2009, the entire contents of which are hereby incorporated by reference.

The sound processing apparatus according to the present invention has an utterer distance determination section that performs determination according to the difference between the levels of two directional microphones and is useful as a hearing aid or the like when the user wishes to hear only the sound of the conversational partner close to the user.

DESCRIPTION OF REFERENCE SIGNS

10 sound processing apparatus
20 sound processing apparatus
30 sound processing apparatus
40 sound processing apparatus
50 sound processing apparatus
1101 directional sound pickup section
1102 microphone array
1103 first directivity forming section
1104 second directivity forming section
103 first level calculation section
104 second level calculation section
105 utterer distance determination section
106 gain derivation section
107 level control section
1201-1 omnidirectional microphone
1201-2 omnidirectional microphone
1202 delay device
1203 arithmetic unit
1204 EG
501 voice activity detection section
601 third level calculation section
602 estimated noise level calculation section
603 level comparison section
604 voice activity determination section
801 self-utterance sound determination section
802 distance determination threshold value setting section
901 adaptive filter
902 delay device
903 difference signal calculation section
904 determination threshold value setting section
1001 conversational partner determination section
3101 nonlinear amplification section
3201 band division section
3202 band signal control section
3202-1 band level calculation section
3202-2 band gain setting section
3202-3 band gain control section
3203 band synthesis section

The invention claimed is:

1. A sound processing apparatus comprising:

a first directivity forming section configured to output a first directivity signal in which a main axis of directivity is formed in a direction of an utterer by using output signals from a plurality of omnidirectional microphones, respectively;

a second directivity forming section configured to output a second directivity signal in which a dead zone of directivity is formed in the direction of the utterer by using the output signals from the respective omnidirectional microphones;

a first level calculation section configured to calculate a level of the first directivity signal output from the first directivity forming section;

a second level calculation section configured to calculate a level of the second directivity signal output from the second directivity forming section;

an utterer distance determination section configured to determine a distance to the utterer based on the level of the first directivity signal and the level of the second directivity signal calculated by the first and second level calculation sections;

a gain derivation section configured to derive a gain to be given to the first directivity signal according to a result of the utterer distance determination section, and a level control section configured to control the level of the first directivity signal by using the gain derived from the gain derivation section.

2. The sound processing apparatus according to claim 1, further comprising:

a voice activity detection section configured to detect a speech interval of the first directivity signal, wherein the utterer distance determination section determines the distance to the utterer based on the sound signal in the speech interval detected by the voice activity detection section.

3. The sound processing apparatus according to claim 2, further comprising:

a self-utterance sound determination section configured to determine whether sound is self-utterance sound based on the level of the first directivity signal in the speech interval detected by the voice activity detection section; and a distance determination threshold value setting section configured to estimate reverberant sound contained in the self-utterance sound detected by the self-utterance sound determination section, and configured to set determination threshold values used when the utterer distance determination section determines the distance to the utterer, wherein the utterer distance determination section determines the distance to the utterer by using the determination threshold values set by the distance determination threshold value setting section.

4. The sound processing apparatus according to claim 3, further comprising:

a conversational partner determination section configured to determine whether the sound of the utterer determined by the utterer distance determination section is produced by a conversational partner based on the result of the utterer distance determination section and a result of the self-utterance sound determination section, wherein the gain derivation section derives the gain to be given to the first directivity signal according to the result of the utterer distance determination section.

5. A sound processing method comprising:

outputting a first directivity signal in which a main axis of directivity is formed in a direction of an utterer by using output signals from a plurality of omnidirectional microphones, respectively;

outputting a second directivity signal in which a dead zone of directivity is formed in the direction of the utterer by using the output signals from the respective omnidirectional microphones;

calculating a level of the output first directivity signal;

calculating a level of the output second directivity signal;

determining a distance to the utterer based on the calculated level of the first directivity signal and the calculated level of the second directivity signal;

deriving a gain to be given to the first directivity signal according to the determined distance to the utterer, and controlling the level of the first directivity signal by using the derived gain.

6. A hearing aid comprising the sound processing apparatus according to claim 1.

* * * * *